US009711075B2

(12) United States Patent
Lee et al.

(10) Patent No.: US 9,711,075 B2
(45) Date of Patent: Jul. 18, 2017

(54) DISPLAY PANEL AND GATE DRIVER WITH REDUCED POWER CONSUMPTION

(71) Applicant: Samsung Display Co., Ltd., Yongin (KR)

(72) Inventors: Yong Soon Lee, Cheonan-si (KR); Sang-Gon Lee, Daejeon (KR)

(73) Assignee: Samsung Display Co., Ltd., Yongin-si (KR)

( * ) Notice: Subject to any disclaimer, the term of this patent is extended or adjusted under 35 U.S.C. 154(b) by 236 days.

(21) Appl. No.: 14/542,960

(22) Filed: Nov. 17, 2014

(65) Prior Publication Data

US 2015/0187247 A1 Jul. 2, 2015

(30) Foreign Application Priority Data

Dec. 30, 2013 (KR) ..... 10-2013-0167495

(51) Int. Cl.
*G09G 5/00* (2006.01)
*G09G 3/20* (2006.01)

(52) U.S. Cl.
CPC ..... *G09G 3/20* (2013.01); *G09G 2310/0267* (2013.01); *G09G 2310/0286* (2013.01); *G09G 2310/08* (2013.01)

(58) Field of Classification Search
CPC ..... G09G 3/20; G09G 2310/0267; G09G 2310/0286; G09G 2310/08
See application file for complete search history.

(56) References Cited

U.S. PATENT DOCUMENTS 5,990,857 A * 11/1999 Kubota ..... G09G 3/3648 345/100
6,909,417 B2 * 6/2005 Washio ..... G09G 3/3688 326/39
7,116,306 B2 * 10/2006 Lin ..... G09G 3/3648 345/100
7,639,226 B2 * 12/2009 Kim ..... G09G 3/3677 345/100
8,457,267 B2 * 6/2013 Trotta ..... H04J 3/0614 375/316
8,547,319 B2 * 10/2013 Hwang ..... G09G 3/3677 345/100
9,147,496 B2 * 9/2015 Abe ..... G11C 19/28
9,343,028 B2 * 5/2016 Ki ..... G09G 3/3677
9,343,030 B2 * 5/2016 Kim ..... G09G 3/3677
9,489,879 B2 * 11/2016 Abe ..... G11C 19/28
(Continued)

FOREIGN PATENT DOCUMENTS

JP 2006-308833 11/2006
KR 10-1167663 7/2012

*Primary Examiner* — Peter D McLoone
(74) *Attorney, Agent, or Firm* — H.C. Park & Associates, PLC

(57) ABSTRACT

An exemplary embodiment of the present invention provides a display panel including: a display area configured to include a gate line and a data line; and a gate driver connected to one terminal of the gate line, the gate driver including a plurality of stages and being integrated on a substrate to output a gate voltage. The stages are divided into at least two stage groups, a first pair of clock signals including a first clock signal and a first clock-bar signal is applied to a first one of the stage groups, and the first pair of clock signals is not swung for a time period in one frame.

19 Claims, 20 Drawing Sheets

(56) References Cited

U.S. PATENT DOCUMENTS

| | | | | |
|---|---|---|---|---|
| 2003/0174115 | A1* | 9/2003 | Washio | G09G 3/3688 345/98 |
| 2004/0227716 | A1* | 11/2004 | Lin | G09G 3/3648 345/99 |
| 2006/0007085 | A1* | 1/2006 | Kim | G11C 19/28 345/87 |
| 2008/0012842 | A1 | 1/2008 | Mori | |
| 2009/0273552 | A1 | 11/2009 | Hwang et al. | |
| 2010/0134399 | A1* | 6/2010 | Ki | G09G 3/3677 345/94 |
| 2011/0157263 | A1* | 6/2011 | Kim | G09G 3/3677 345/698 |
| 2012/0155585 | A1* | 6/2012 | Trotta | H04J 3/0614 375/354 |
| 2012/0306844 | A1* | 12/2012 | Abe | G11C 19/28 345/212 |
| 2013/0009919 | A1 | 1/2013 | Park et al. | |
| 2013/0088480 | A1 | 4/2013 | Hong et al. | |
| 2013/0106677 | A1 | 5/2013 | Koo et al. | |
| 2015/0346844 | A1* | 12/2015 | Abe | G11C 19/28 345/212 |

* cited by examiner

DISPLAY PANEL AND GATE DRIVER WITH REDUCED POWER CONSUMPTION

CROSS-REFERENCE TO RELATED APPLICATION

This application claims priority from and the benefit of Korean Patent Application No. 10-2013-0167495, filed on Dec. 30, 2013, which is incorporated herein by reference for all purposes as if fully set forth herein.

BACKGROUND

Field

The present disclosure relates to a display panel, and more particularly, to a display panel including a gate driver integrated therein.

Discussion of the Background

Liquid crystal displays are now widely adopted and used among various types of display devices as one type of flat panel displays. An exemplary liquid crystal display has two display panels on which field generating electrodes, such as pixel electrodes and a common electrode are formed, respectively, and a liquid crystal layer that is interposed between the display panels. The liquid crystal display applies voltages to the field generating electrodes so as to generate an electric field in the liquid crystal layer, which in turn determines the alignment of liquid crystal molecules of the liquid crystal layer and the polarization of incident light, thereby providing an image display. Examples of a display panel device include an organic light emitting device, a plasma display device, and an electrophoretic display, as well as the liquid crystal display.

A display device includes a gate driver and a data driver. Among them, the gate driver may be integrated with the panel by being patterned along with a gate line, a data line, and a thin film transistor. If the integrated gate driver does not require an additional gate driving chip, it is possible to save manufacturing costs of producing a display device.

However, since a large number of thin film transistors having large sizes are formed in the integrated gate driver, parasitic capacitance therein is large. As a result, the power consumption caused by the parasitic capacitance is increased. Thus, for a device including an integrated gate driver, the reduced power consumption by resolving the parasitic capacitance problem would increase the efficiency and quality of the device.

The above information disclosed in this Background section is only for enhancement of understanding of the background of the invention and therefore it may contain information that does not form the prior art that is already known in this country to a person of ordinary skill in the art.

SUMMARY

The exemplary embodiments of the present invention provide a display panel having a gate driver mounted therein. Reduced power consumption may be attained for the mounted gate driver by providing partially non-swing clock signals into the gate driver.

Additional aspects will be set forth in part in the description which follows and, in part, will be apparent from the description, or may be learned by practice of the presented embodiments.

An exemplary embodiment of the present invention provides a display panel including: a display area configured to include a gate line and a data line; and a gate driver connected to one terminal of the gate line, the gate driver including a plurality of stages and being integrated on a substrate to output a gate voltage, wherein the stages are divided into at least two stage groups, a first pair of clock signals including a first clock signal and a first clock-bar signal is applied to a first one of the stage groups, and the first pair of clock signals is not swung for a time period in one frame.

An exemplary embodiment of the present invention provides a gate driver including: a first stage to receive a first clock signal and to output a first gate output to a first gate line; a second stage to receive a first clock-bar signal and to output a second gate output to a second gate line; a third stage to receive a second clock signal and to output a third gate output to a third gate line; and a fourth stage to receive a second clock-bar signal and to output a fourth gate output to a fourth gate line. The first clock signal, the first clock-bar signal, the second clock signal, and the second clock-bar signal have a same period. The first clock signal and the first clock-bar signal swing in a first time duration within the period, and the second clock signal and the second clock-bar signal do not swing in the first time duration in which the first clock signal and the first clock-bar signal swing.

In accordance with the exemplary embodiments of the present invention, power used at each stage in the gate driver is reduced by allowing the clock signal applied to each stage to not be swung during a certain time period in one frame, thereby reducing the power consumption of the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
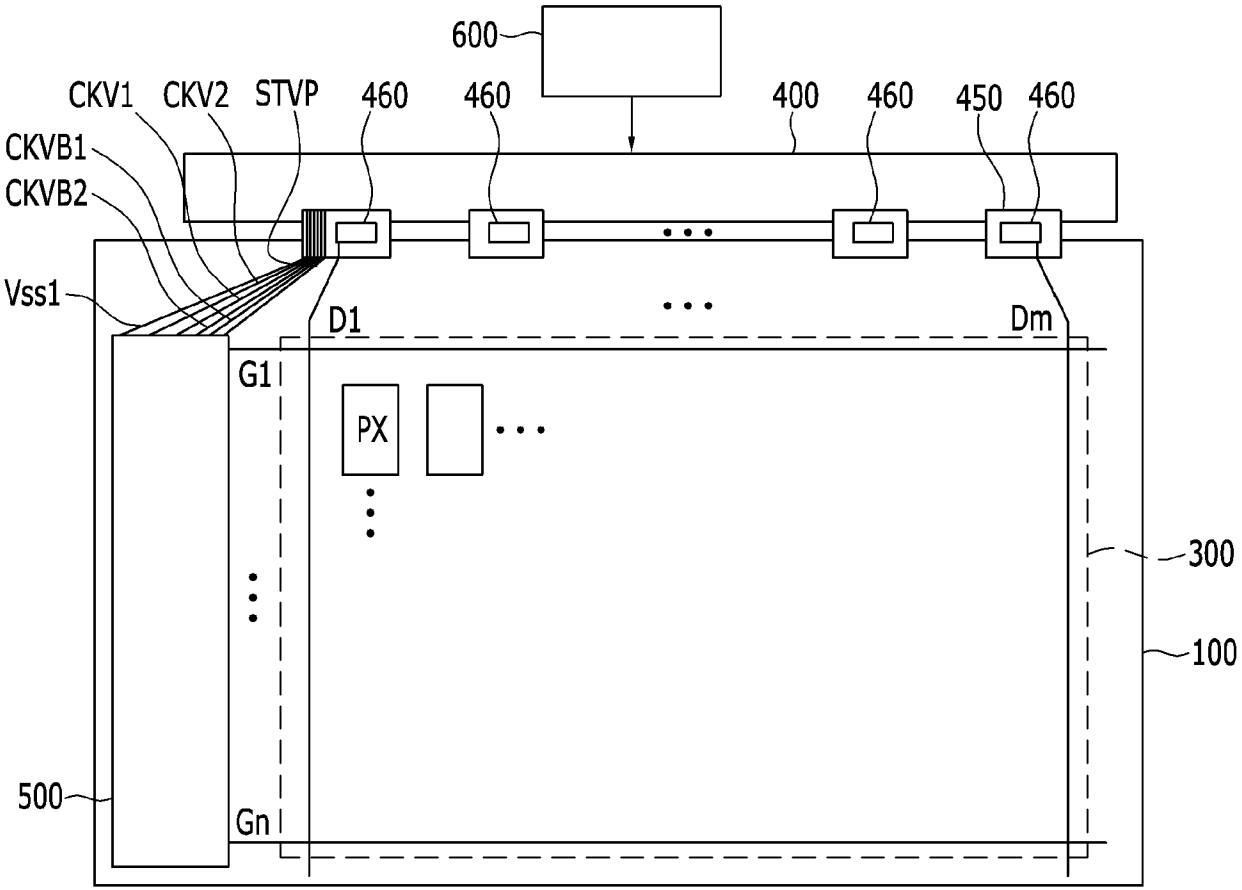
FIG. 1 is a top plan view of a display panel according to an exemplary embodiment of the present invention.

Hereinafter, exemplary embodiments of the present invention will be described in detail with reference to the accompanying drawings. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments and is not intended to be limiting. As used herein, the singular forms "a", "an", and "the" are intended to include the plural forms as well, unless the context clearly indicates otherwise. It will be further understood that the terms "comprises," "includes," "including," and/or "comprising," when used herein, specify the presence of stated features, components, groups, elements, steps, operations, and/or devices thereof, but do not preclude the presence or addition of one or more other features, components, groups, elements, steps, operations, and/or devices thereof. Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure. Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Hereinafter, a display device according to an exemplary embodiment of the present invention will be described with reference to FIG. 1.

FIG. 1 is a top plan view of a display panel according to an exemplary embodiment of the present invention.

Referring to FIG. 1, the display panel 100 includes a display area 300 to display image, and a gate driver 500 to apply a gate voltage to a gate line of the display area 300. A data line of the display area 300 is applied with a data voltage from a data driver IC 460 formed on a film such as a flexible printed circuit (FPC) film 450 attached to the display panel 100. The gate driver 500 and the data driver IC 460 are controlled by a signal controller 600. A printed circuit board (PCB) 400 may be formed outside the film, such as the flexible printed circuit film 450, to transmit the signal from the signal controller 600 to the data driver IC 460 and the gate driver 500. The signal provided from the signal controller 600 may include signals, such as a pair of first clock signals CKV1 and CKVB1, a pair of second clock signals CKV2 and CKVB2, a scan start signal STVP, and a signal providing a low voltage Vss1 of a predetermined level. The low voltage Vss1 may include a plurality of low voltages in accordance with another embodiment of the present invention. Herein, the pair of clock signals includes a clock signal CKV and a clock-bar signal CKVB, and the clock signal CKV and the clock-bar signal CKVB may have the same cycle but have inverted phases.

The display area 300 includes a plurality of gate lines G1 to Gn and a plurality of data lines D1 to Dm. The plurality of gate lines G1 to Gn and the plurality of data lines D1 to Dm are insulated from and intersect each other.

The display area 300 includes a plurality of pixels PX. If the display panel is a liquid display panel, each pixel PX may include a thin film transistor and a liquid crystal capacitor. If the display panel is an organic light emitting display panel, each pixel PX may include a thin film transistor, a driving transistor, and an organic light emitting diode. Further, the display panel may be flat display panels other than the liquid crystal panel and the organic light emitting display panel.

Each pixel PX may include a thin film transistor for applying a data voltage to a corresponding pixel. In this case, a control terminal of the thin film transistor is connected to a gate line, an input terminal of the thin film transistor is connected to a data line, and an output terminal of the thin film transistor is connected to a pixel electrode. The pixel electrode may be a terminal of the liquid crystal capacitor in the case of the liquid crystal display panel, and the pixel electrode may serve to control a driving transistor for allowing a current to flow to an end of an organic light emitting diode in the case of the organic light emitting display device. The position of the pixel electrode may vary depending on the structure of the pixel PX.

The plurality of data lines D1 to Dm receive the data voltage from the data driver IC 460, and the plurality of gate lines G1 to Gn receive the gate voltage from the gate driver 500.

The data driver IC 460 may be formed at upper and lower sides of the display panel 100 and is connected to the data lines D1 to Dm extending in a vertical direction. As shown in FIG. 1, the data driver IC 460 may be disposed at an upper side of the display panel 100.

The gate driver 500 receives the first clock signals CKV1 and CKVB1, the second clock signals CKV2 and CKVB2, the scan start signal STVP, and the low voltage Vss1 corresponding to a gate-off voltage to generate a gate voltage (a gate-on voltage and a gate-off voltage), and sequentially applies the gate-on voltage to the gate lines G1 to Gn.

When applied to the gate driver 500, the clock signals CKV and CKVB (e.g., the first clock signals CKV1 and CKVB1, and the second clock signals CKV2 and CKVB2), the scan start signal STVP, and the low voltage Vss1 may be applied to the gate driver 500 through the flexible printed circuit film 450 disposed closest to the gate driver 500 among the flexible printed circuit films 450 in which the data driver IC 460s are positioned These signals may be transmitted to a film such as the flexible printed circuit film 450 through the PCB 400 from the outside, or the signal controller 600.

The gate driver 500 may include a plurality of stages, which are divided into at least two stage groups. The pair of clock signals including the clock signal and the clock-bar signal may be applied to each stage group. The first pair of clock signals may be applied to a first stage group and the second pair of clock signals may be applied to a second stage group. Further, the pair of clock signals is not swung for one frame. The gate driver 500 may be an amorphous silicon gate driver (ASG) integrated in a panel. If the gate driver 500 is integrated on a substrate of a panel without using a separate gate driver-IC, the production cost may be reduced. Further, the display quality deterioration by a gate block may also be reduced and other various benefits, such as processing time reduction, may be attained. However, unlike the CMOS process, the integrated ASG gate driver may have a problem of increased power consumption due to e.g., increased parasitic capacitance generated from the integration of the gate IC on a panel. According to aspects of the present invention, exemplary embodiments described herein may provide a gate driver having a reduced power consumption property without such problems.

Hereinafter, the gate driver 500 and the gate lines G1 to Gn according to an exemplary embodiment of the present invention will be described.

Figure 2:
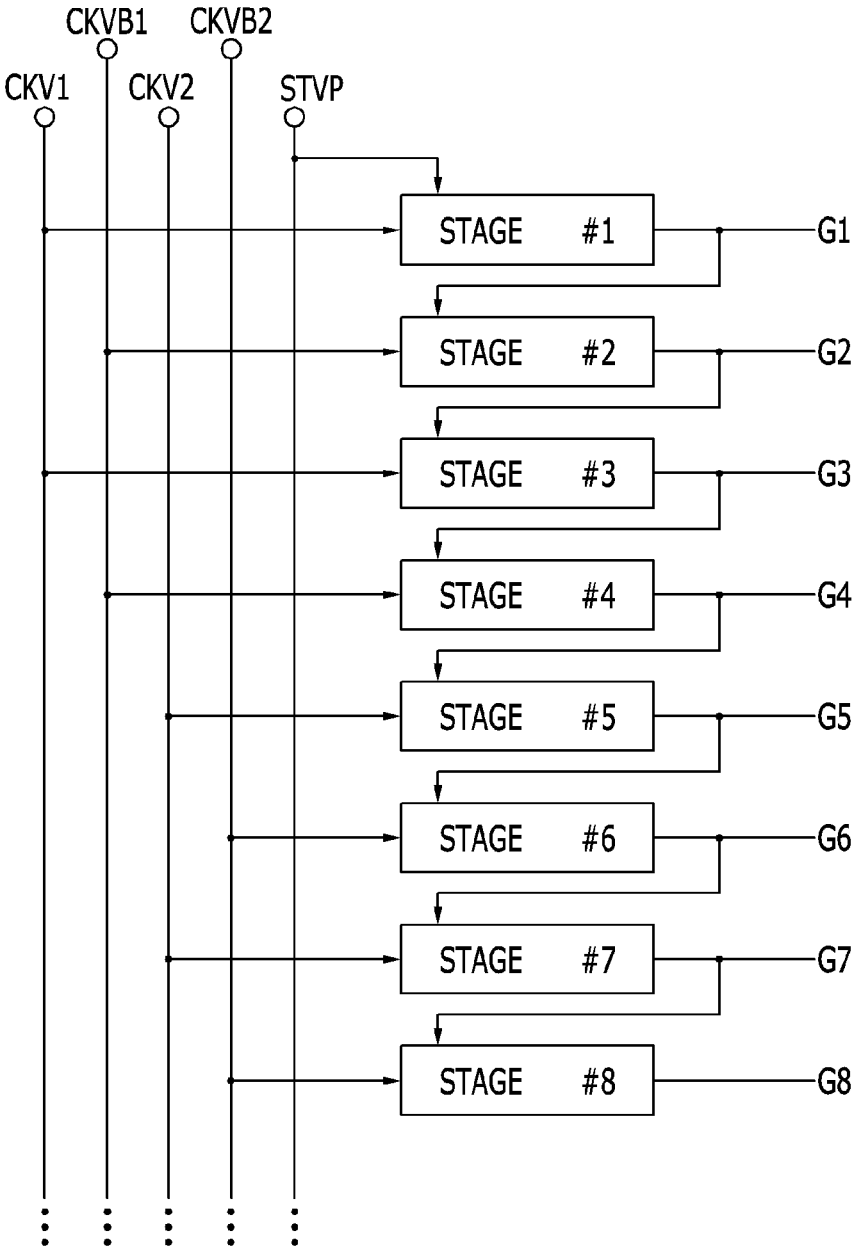
FIG. 2 is a block diagram showing a gate driver and a gate line according to an exemplary embodiment of the present invention.

FIG. 2 is a block diagram showing a gate driver and gate lines according to an exemplary embodiment of the present invention.

In FIG. 2, the gate driver 500 is blocked, and only some stages (8 stages) and the gate lines are shown.

First, the gate driver 500 will be described.

The gate driver 500 includes a plurality of stages STAGE #1, STAGE #2, STAGE #3, STAGE #4, . . . , STAGE #N that are dependently connected to each other. Each of the stages STAGE #1, STAGE #2, STAGE #3, STAGE #4, . . . , STAGE #N includes one clock input terminal (STVP for STAGE #1 or a terminal into which an output of the previous stage is inputted) and one clock input terminal (one terminal of CKV1, CKVB1, CKV2, and CKVB2 into which one clock signal is inputted). Each of the stages STAGE #1, STAGE #2, STAGE #3, STAGE #4, . . . , STAGE #N may further include a terminal (not shown) into which the low voltage Vss1 corresponding to the gate-off voltage is inputted. Further, each of the stages STAGE #1, STAGE #2, STAGE #3, STAGE #4, . . . , STAGE #N includes a gate voltage output terminal for outputting a gate voltage. In accordance with another exemplary embodiment of the present invention, each stage STAGE #1, STAGE #2, STAGE #3, STAGE #4, . . . , STAGE #N may further include an output terminal for outputting a transfer signal corresponding to the gate voltage or an output terminal for outputting an output signal of an inverter included in a stage The stages STAGE #1, STAGE #2, STAGE #3, STAGE #4, . . . , STAGE #N are connected to the gate lines one by one, and the output of each stage is applied as a gate voltage for the corresponding gate line.

An operation of each of the stages STAGE #1, STAGE #2, STAGE #3, STAGE #4, . . . , STAGE #N is started by a signal inputted through the input terminal, and a high-level gate-on voltage is generated through a boost-up operation according to an inputted clock signal. Herein, the signal inputted through the input terminal is a gate voltage of the previous stage. However, the first stage STAGE #1 receives a scan start signal STVP since a previous stage of the first stage STAGE #1 does not exist. As a result, the gate driver 500 sequentially outputs gate-on voltages by the scan start signal STVP.

The pair of first clock signals CKV1 and CKVB1 and the pair of second clock signals CKV2 and CKVB2 may be applied to STAGE #1, STAGE #2, STAGE #3, STAGE #4, . . . , STAGE #N in accordance with the exemplary embodiment of FIG. 2. More specifically, the stages STAGE #1, STAGE #2, STAGE #3, STAGE #4, . . . , STAGE #N may be divided into a first stage group to which the pair of first clock signals CKV1 and CKVB1 is applied and a second stage group to which the pair of second clock signals CKV2 and CKVB2 is applied. For example, if the gate driver 500 includes N stages from STAGE #1 to STAGE #N (N is an even number), the first stage group may include STAGE #1, STAGE #2, . . . , STAGE (N/2) and the second stage group may include STAGE #(N/2+1), STAGE #(N/2+2), . . . , STAGE #N. The first clock signal CKV1 may be applied to odd-numbered stages in the first stage group and the first clock-bar signal CKVB1 may be applied to even-numbered stages in the first stage group. The second clock signal CKV2 may be applied to odd-numbered stages in the second stage group and the second clock-bar signal CKVB2 may be applied to even-numbered stages in the second stage group. Alternatively, clock signals CKV1 and CKV2 may be applied to even-numbered stages, and clock-bar signals CKVB1 and CKVB2 may be applied to odd-numbered stages.

Further, according to another exemplary embodiment of the present invention, the first stage group may include STAGE #(8A+1), STAGE #(8A+2), STAGE #(8A+3), and STAGE #(8A+4) and the second stage group may include STAGE #(8A+5), STAGE #(8A+6), STAGE #(8A+7), and STAGE #(8A+8). Here, the number A may be a non-negative integer, e.g., 0, 1, 2, . . . ). The first clock signal CKV1 may be applied to odd-numbered stages STAGE #(8A+1) and STAGE #(8A+3) in the first stage group and the first clock-bar signal CKVB1 may be applied to even-numbered stages STAGE #(8A+2) and STAGE #(8A+4) in the first stage group. The second clock signal CKV2 may be applied to odd-numbered stages STAGE #(8A+5) and STAGE #(8A+7) in the second stage group and the second clock-bar signal CKVB2 may be applied to even-numbered stages STAGE #(8A+6) and STAGE #(8A+8) in the second stage group. Alternatively, clock signals CKV1 and CKV2 may be applied to even-numbered stages, and clock-bar signals CKVB1 and CKVB2 may be applied to odd-numbered stages.

In the exemplary embodiment shown in FIG. 2, only 8 stages are shown. As shown in FIG. 2, the first stage to the fourth stage belong to the first stage group and the fifth stage to the eighth stage belong to the second stage group. According to the configuration shown in FIG. 2, the total gate lines G1, G2, . . . , G8 are divided into two groups, and the stages connected to the first half of the gate lines G1, G2, G3, and G4 belong to the first stage group and the stages connected to the second half of the gate lines G5, G6, G7, and G8 belong to the second stage group. If 1080 gate lines are provided, 540 stages and 540 stages may respectively belong to the first stage group and the second stage group.

As shown in FIG. 2, clock signals of the pair of the first clock signals CKV1 and CKVB1 are alternately applied to the 4 stages belonging to the first stage group. Specifically, the clock signal CKV1, the clock-bar signal CKVB1, the clock signal CKV1, and the clock-bar signal CKVB1 are respectively applied to the first stage, the second stage, the third stage, and the fourth stage.

Herein, the clock signal CKV1 and the clock-bar signal CKVB1 may have inverted phases, and may have constant voltage levels which are not swung during a time period in one frame.

Similarly, clock signals of the pair of the second clock signals CKV2 and CKVB2 are alternately applied to the 4 stages belonging to the second stage group. Specifically, the clock signal CKV2, the clock-bar signal CKVB2, the clock signal CKV2, and the clock-bar signal CKVB2 are respectively applied to the fifth stage, the sixth stage, the seventh stage, and the eighth stage.

Herein, the clock signal CKV2 and the clock-bar signal CKVB2 may have inverted phases, and may have constant voltage levels which are not swung during a time period in one frame.

Hereinafter, waveforms of signals applied to the stages STAGE #1, STAGE #2, STAGE #3, STAGE #4, . . . , STAGE #N will be described with reference to FIG. 3.

Figure 3:
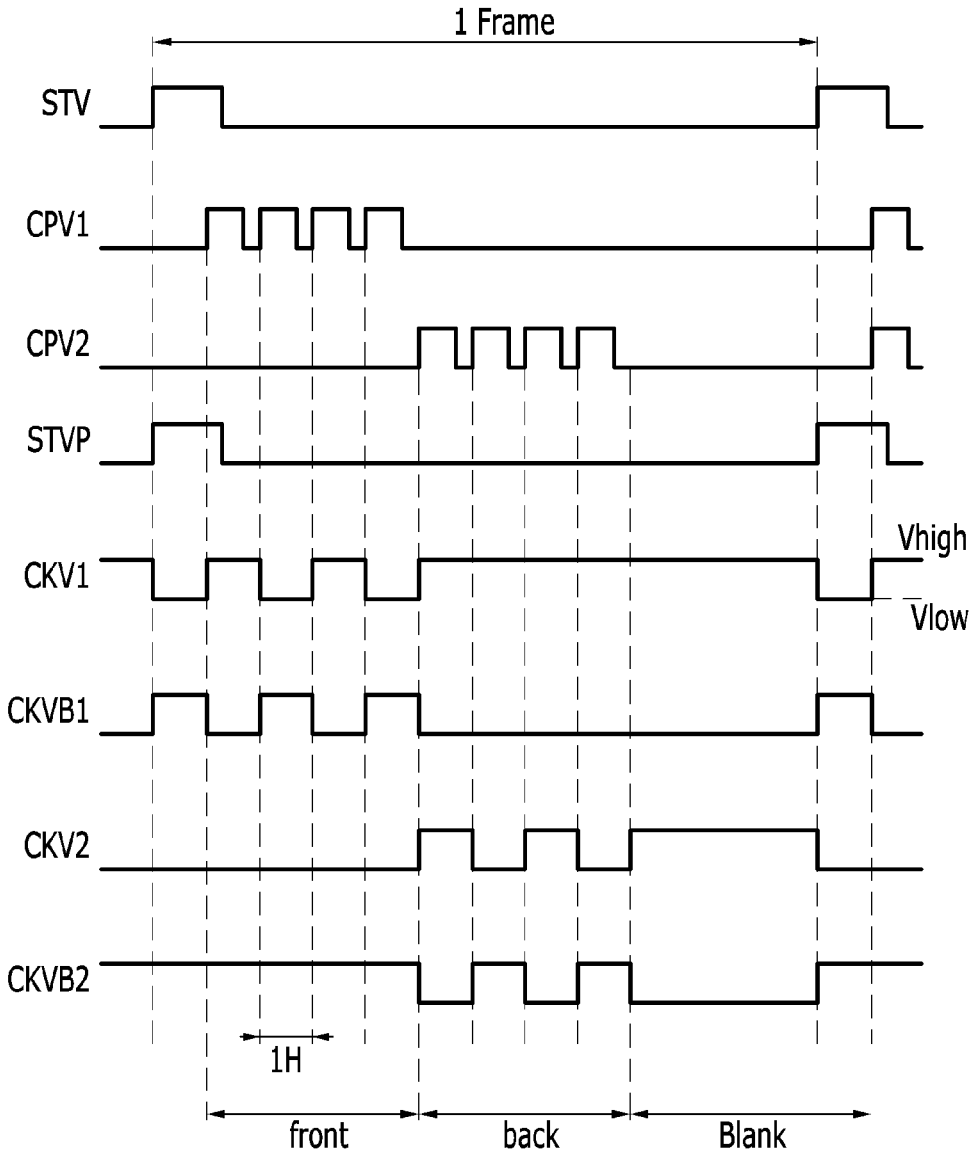
FIG. 3 is a waveform diagram showing signal waveforms of the gate driver shown in FIG. 2 according to an exemplary embodiment of the present invention.

FIG. 3 is a waveform diagram showing signal waveforms of the gate driver shown in FIG. 2 according to an exemplary embodiment of the present invention.

In FIG. 3, the scan start signal STVP, the pair of first clock signals CKV1 and CKVB1, the pair of second clock signals CKV2 and CKVB2, a base signal STV, a base CPV1, and a base CPV2 are shown. The scan start signal STVP, the pair of first clock signals CKV1 and CKVB1, and the pair of second clock signals CKV2 and CKVB2 may be generated based on the base signal STV, the base CPV1, and the base CPV2.

First, the base signal STV serves as a start voltage signal to determine one frame, and may have the same phase and cycle as those of the scan start signal STVP. The scan start signal STVP applied to the gate driver 500 may be generated based on the base signal STV, but aspects are not limited as such. For example, the same signal STV may be used as the scan start signal STVP.

The base CPV1 and the base CPV2 serve to set a clock signal and have a constant voltage level which is not swung during a time period in one frame. For example, as shown in FIG. 3, the base CPV1 has a constant voltage level without swing in the 'back' period in one frame and the base CPV2 has a constant voltage level without swing in the 'front' period in one frame. In the exemplary embodiment of FIG. 3, the voltage level may not be swung for about a half of one frame (i.e., a half frame or a little less than a half frame or a little more than a half frame). The base CPV1 and the base CPV2 may be generated by screening the continuous CPV signal for a time period (half frame). The base CPV1 and the base CPV2 respectively serve as base signals for the pair of first clock signals CKV1 and CKVB1 and the pair of second clock signals CKV2 and CKVB2. Further, the 'front' half of the continuous CPV signal may be taken and used as a base signal for the pair of the first clock signals CKV1 and CKVB1, and the 'back' half of the continuous CPV signal may be taken and used as a base signal for the pair of the second clock signals CKV2 and CKVB2. Various elements such as switches may be used to distinguish the base CPV1 and the base CPV2 from the continuous CPV signal. Specifically, the pair of first clock signals CKV1 and CKVB1 may be generated based on the base CPV1 such that the clock signal is inverted per rising edge and the clock signal CKV1 and the clock-bar signal CKVB1 have inverted phases. Further, since the base CPV1 having a constant level has no rising edge, the pair of first clock signals CKV1 and CKVB1 also have constant levels which are not swung during about a half frame. Similarly, the pair of second clock signals CKV2 and CKVB2 may be generated based on the base CPV2 such that the clock signal is inverted per rising edge and the clock signal CKV2 and the clock-bar signal CKVB2 have inverted phases. Further, since the base CPV2 having a constant level has no rising edge, the pair of second clock signals CKV2 and CKVB2 also have constant levels which are not swung during about a half frame.

The base CPV1 and the base CPV2 are not overlapped with each other and have the same cycle. In such a configuration, if the base CPV1 and the base CPV2 are summed, one signal having a constant cycle is generated, e.g., the CPV. As a result, the pair of first clock signals CKV1 and CKVB1 generated based on e.g., the base CPV1 and the pair of second clock signals CKV2 and CKVB2 generated based on e.g., the base CPV2 also have the same cycle.

In FIG. 3, a first period during which the first stage group is operated by receiving the pair of first clock signals CKV1 and CKVB1 is marked as "front" representing a front section and a second period during which the second stage group is operated by receiving second clock signals CKV2 and CKVB2 is marked as "back" representing a back section.

In the exemplary embodiment of FIG. 3, each of the front section and the back section occupies about a half frame.

In accordance with the exemplary embodiment illustrated in FIG. 3, the pair of clock signals applied to each stage group have the same cycle.

The first pair of first clock signals, the CKV1 and CKVB1, is alternately applied to the first stage group, and the second pair of second clock signals, the CKV2 and CKVB2, is alternately applied to the second stage group.

The number of stages belonging to the first stage group may be the same as the number of stages belonging to the second stage group.

The pair of first clock signals has a first section in which the clock signal is applied and a second section in which no swing is performed, and the pair of second clock signals has a first section in which the clock signal is applied and a second section in which no swing is performed. The first section of the pair of the first clock signals may correspond to the second section of the pair of the second clock signals, and the second section of the pair of the first clock signals may correspond to the first section of the pair of the second clock signals.

In the exemplary embodiment of FIG. 3, each of the first section in which the clock signal is applied and the second section in which no swing is performed occupies about a half frame for the pair of first clock signals. Each of the first section in which the clock signal is applied and the second section in which no swing is performed occupies about a half frame for the pair of second clock signals.

The cycle of the clock signal at the first section in which the clock signal is applied for the pair of the first clock signals is the same as the cycle of the clock signal at the first section in which the clock signal is applied for the pair of the second clock signals.

Further, the base signals CPV1 and CPV2 may have a frequency of 1/H if the gate on time duration of gate output signal (e.g., gate output voltage) is 1H (e.g., μsec). Then, the clock signals CKV1, CKVB1, CKV2, and CKVB2 have a frequency of 1/(2H) if the clock signals CKV1, CKVB1, CKV2, and CKVB2 swing. If clock signals CKV1, CKVB1, CKV2, and CKVB2 do not swing, the clock signals CKV1, CKVB1, CKV2, and CKVB2 may have a constant voltage $V_{HIGH}$ or a constant voltage $V_{LOW}$. Further, the voltage different between $V_{HIGH}$ and $V_{LOW}$, which is ΔV, is related to the amount of power consumption and the power consumption difference will be described in detail with reference to Table 1 below.

Further, as shown in FIG. 3, in each frame, a blank time period, e.g., a residual time period in which all clock signals do not swing, may exist. The residual time period may be located at the end of each frame as shown in FIG. 3, but aspects are not limited as such. The residual time period may be located at the beginning of each frame or the residual time period may not exist.

Hereinafter, outputs of a gate-on voltage of the gate driver 500 to which the signals shown in FIG. 3 are applied will be described with reference to FIG. 4.

Figure 4:
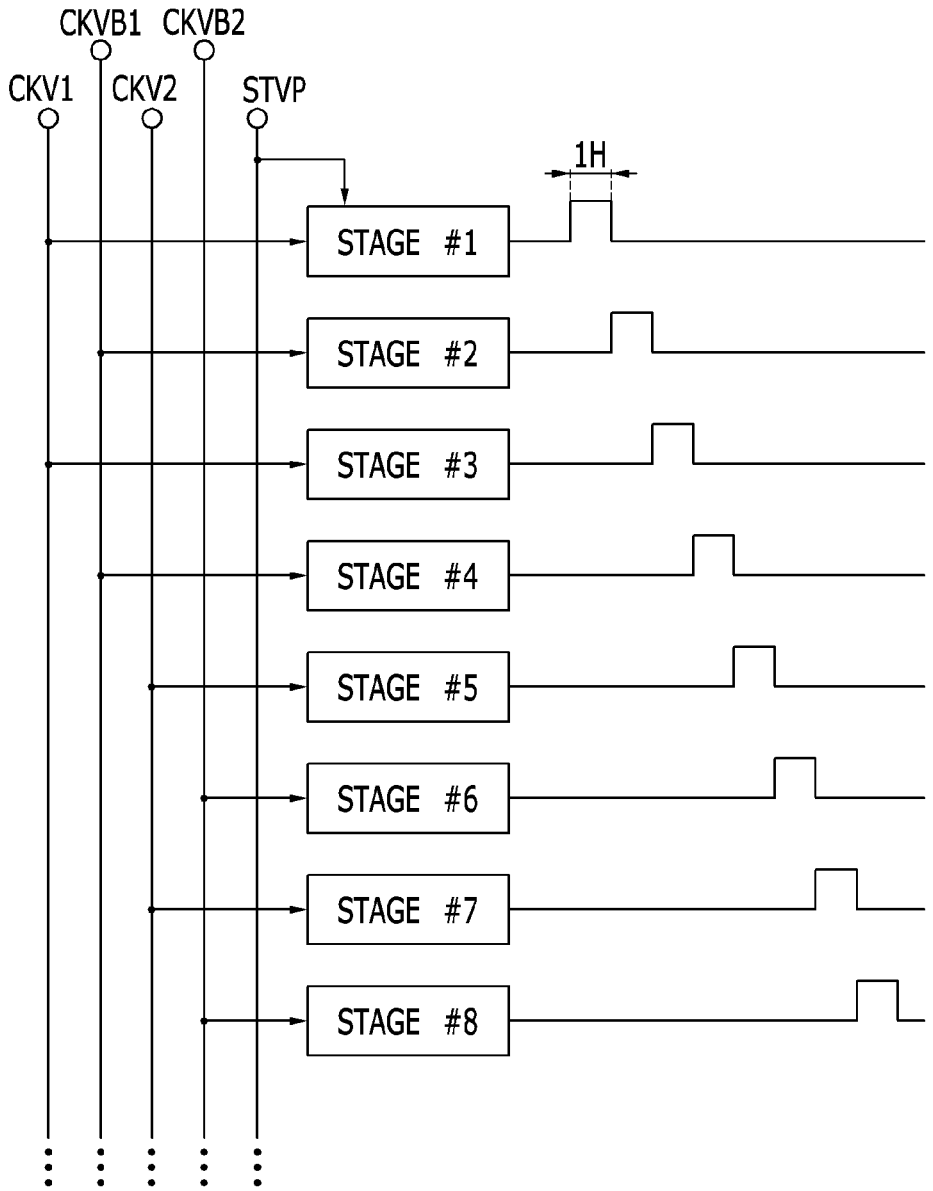
FIG. 4 shows outputs of the gate driver shown in FIG. 2 according to an exemplary embodiment of the present invention.

FIG. 4 shows outputs of the gate driver shown in FIG. 2 according to an exemplary embodiment of the present invention.

An exemplary operation of the gate driver 500 to which the signals of FIG. 3 are applied will be described as follows.

First, the first stage STAGE #1 receives the clock signal CKV1 supplied from the outside through the clock input terminal of the first stage and the scan start signal STVP through the input terminal of the first stage, and outputs a gate-on voltage to the first gate line G1 through the gate voltage output terminal of the first stage. In this case, the outputted gate-on voltage is transferred to or fed into the input terminal of the second stage STAGE #2. In accordance with another exemplary embodiment of the present invention, a transfer signal corresponding to the gate-on voltage may be transferred to or fed into the second stage STAGE #2.

The second stage STAGE #2 receives the clock-bar signal CKVB1 supplied from the outside through the clock input terminal of the second stage, receives the gate-on voltage of the first stage STAGE #1 through the input terminal of the second stage, and outputs a gate-on voltage to the second gate line G2 through the gate voltage output terminal of the second stage. In this case, the outputted gate-on voltage is transferred to or fed into the input terminal of the third stage STAGE #3. In accordance with another exemplary embodiment of the present invention, a transfer signal corresponding to the gate-on voltage may be transferred to or fed into the input terminal of the third stage STAGE #3.

These operations are repeated until the last stage (e.g., the fourth stage in FIG. 2) belonging to the first stage group generates and outputs a gate-on voltage.

Specifically, the third stage STAGE #3 receives the clock signal CKV1 supplied from the outside through the clock input terminal of the third stage and the gate-on voltage of the second stage STAGE #2 through the input terminal of the third stage, and outputs a gate-on voltage to the third gate line G3 through the gate voltage output terminal of the third stage. In this case, the outputted gate-on voltage of the third stage is transferred to or fed into the input terminal of the fourth stage STAGE #4. In accordance with another exemplary embodiment of the present invention, a transfer signal corresponding to the gate-on voltage may be transferred to or fed into the second stage STAGE #4. The fourth stage STAGE #4 receives the clock-bar signal CKVB1 supplied from the outside through the clock input terminal of the fourth stage, receives the gate-on voltage of the third stage STAGE #3 through the input terminal of the fourth stage, and outputs a gate-on voltage to the fourth gate line G4 through the gate voltage output terminal of the fourth stage. The gate-on voltage outputted from the fourth stage STAGE #4 is transferred to or fed into the input terminal of the fifth stage STAGE #5. In accordance with another exemplary embodiment of the present invention, a transfer signal corresponding to the gate-on voltage may be transferred to or fed into the fifth stage STAGE #5.

The fifth stage STAGE #5 belonging to the second stage group receives the clock signal CKV2 supplied from the outside through the clock input terminal of the fifth stage, receives the gate-on voltage of the fourth stage STAGE #4 through the input terminal of the fifth stage, and outputs a gate-on voltage to the fifth gate line G5 through the gate voltage output terminal of the fifth stage. In this case, the outputted gate-on voltage is transferred to or fed into the input terminal of the sixth stage STAGE #6. In accordance with another exemplary embodiment of the present invention, a transfer signal corresponding to the gate-on voltage may be transferred to or fed into the input terminal of the sixth stage STAGE #6 without feeding the outputted gate-on voltage of the fifth stage.

The sixth stage STAGE #6 receives the clock-bar signal CKVB2 supplied from the outside through the clock input terminal of the sixth stage, receives the gate-on voltage of the fifth stage STAGE #5 through the input terminal of the sixth stage, and outputs a gate-on voltage to the sixth gate line G6 through the gate voltage output terminal of the sixth stage. In this case, the outputted gate-on voltage of the sixth stage is transferred to or fed into the input terminal of the seventh stage STAGE #7. In accordance with another exemplary embodiment of the present invention, a transfer signal corresponding to the gate-on voltage may be transferred to or fed into the input terminal of the seventh stage STAGE #7 without feeding the outputted gate-on voltage of the sixth stage.

These operations are repeated until the last stage (e.g., the eighth stage in FIG. 2) belonging to the second stage group generates and outputs a gate-on voltage. Specifically, the seventh stage STAGE #7 receives the clock signal CKV2 supplied from the outside through the clock input terminal of the seventh stage and the gate-on voltage of the sixth stage STAGE #6 through the input terminal of the seventh stage, and outputs a gate-on voltage to the seventh gate line G7 through the gate voltage output terminal of the seventh stage. In this case, the outputted gate-on voltage of the seventh stage is transferred to or fed into the input terminal of the eighth stage STAGE #8. In accordance with another exemplary embodiment of the present invention, a transfer signal corresponding to the gate-on voltage may be transferred to or fed into the second stage STAGE #8. The eighth stage STAGE #8 receives the clock-bar signal CKVB2 supplied from the outside through the clock input terminal of the eighth stage, receives the gate-on voltage of the seventh stage STAGE #7 through the input terminal of the eighth stage, and outputs a gate-on voltage to the eighth gate line G8 through the gate voltage output terminal of the eighth stage.

The gate-on voltage outputted from the eighth stage STAGE #8 may be transferred to or fed into the input terminal of the ninth stage STAGE #9. In accordance with another exemplary embodiment of the present invention, a transfer signal corresponding to the gate-on voltage may be transferred to or fed into the ninth stage STAGE #9.

As shown in FIG. 4, the timing of the gate-on voltage of the fifth stage belonging to the second stage group is determined as 1H directly next to the gate-on voltage of the fourth stage belonging to the first stage group. This is because the pair of first clock signals CKV1 and CKVB1 and the pair of second clock signals CKV2 and CKVB2 have the same cycle and the gate-on voltage outputted from the fourth stage STAGE #4 is transferred to or fed into the input terminal of the fifth stage STAGE #5. In other words, this is because if the clock signal CKV1 belonging to the pair of first clock signals CKV1 and CKVB1 and the clock signal CKV2 belonging to the pair of second clock signals CKV2 and CKVB2 are summed, one clock signal having a matched phase is generated, and if the clock-bar signal CKVB1 belonging to the pair of first clock signals CKV1 and CKVB1 and the clock-bar signal CKVB2 belonging to the pair of second clock signals CKV2 and CKVB2 are summed, one clock signal having a matched phase is generated.

Accordingly, as shown in FIG. 4, each of the gate-on voltages of the first stage group and the second stage group is sequentially outputted with a time period of 1H. More specifically, each stage outputs a gate-on voltage having a period of 1H sequentially from the first stage to the eighth stage if the total number of the stages is eight.

Hereinafter, results of simulations for showing the aforementioned operations will be described with reference to FIG. 5 to FIG. 7.

Figure 5:
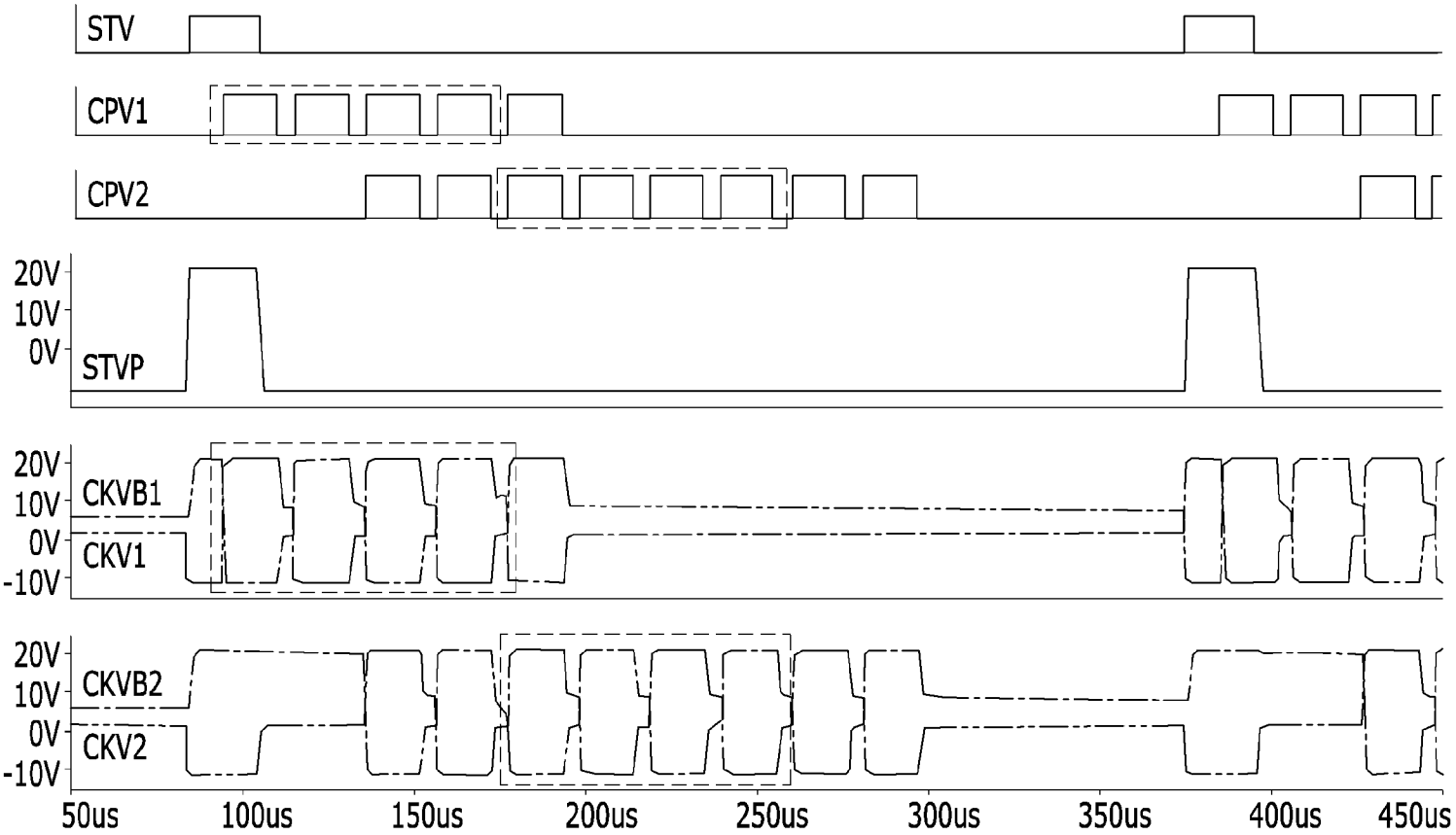
FIG. 5, FIG. 6, and FIG. 7 show simulations of outputs obtained by applying the waveforms shown in FIG. 3 according to an exemplary embodiment of the present invention.
Figure 6:
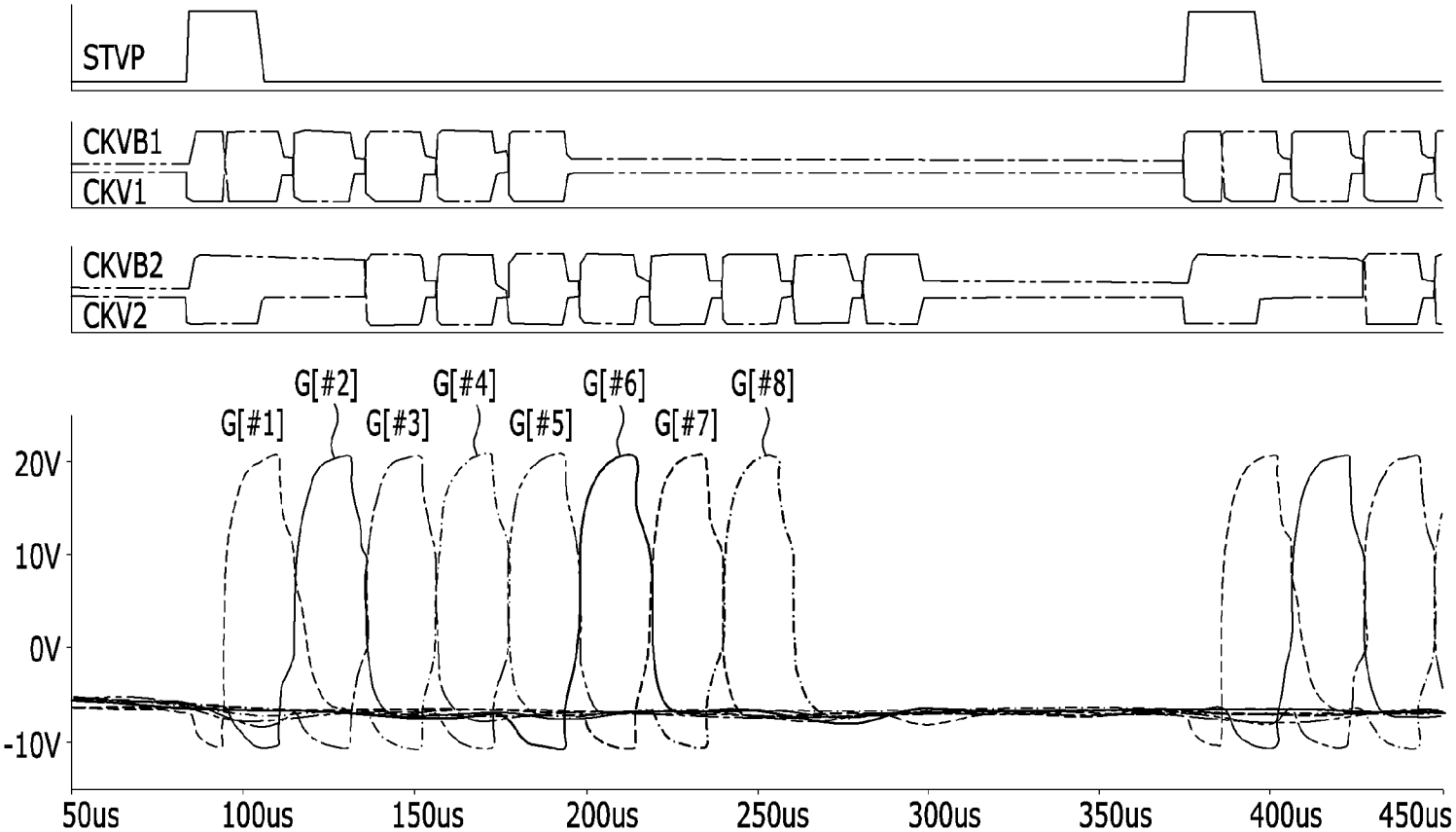
Figure 7:
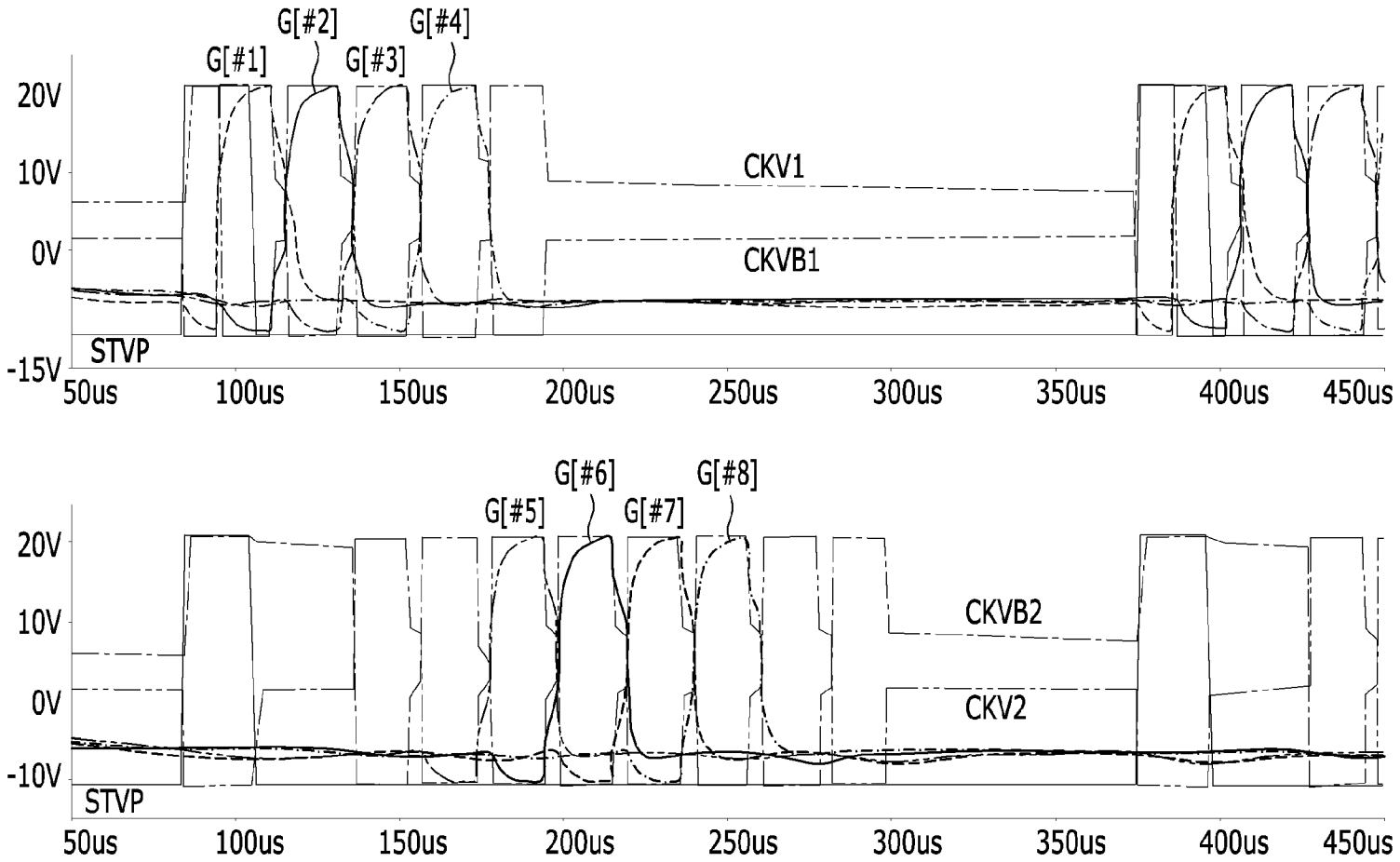

FIG. 5 to FIG. 7 show simulations of outputs obtained by applying the waveforms shown in FIG. 3 according to an exemplary embodiment of the present invention.

In FIG. 5, the base signals STV, CPV1, and CPV2 for the simulations and the corresponding signals STVP, CKV1, CKVB1, CKV2, and CKVB2 are shown. In FIG. 5, the base signals CKV1 and CKVB1 are summed and shown, and the signals CKV2 and CKVB2 are summed and shown. In FIG. 5, the base signals CPV1 and CPV2 and the signals CKV1, CKVB1, CKV2, and CKVB2 are shown to be overlapped with each other. This is because signals that precede or follow each signal are added thereto for the simulations. Unlike FIG. 3, the signal CPV1 shown in FIG. 5 has five square waves and the signal CPV2 shown in FIG. 5 has eight square waves in one frame. Only the signals indicated by doted square boxes in the base signals CPV1 and CPV2 and the signals CKV1, CKVB1, CKV2, and CKVB2 are signals used for the actual operation, and thus correspond to the waveforms shown in FIG. 3.

Among the signals shown in FIG. 5, the signals STVP, CKV1, CKVB1, CKV2, and CKVB2 which are transferred to the gate driver 500 are also shown in an upper side of FIG. 6. The gate-on voltages generated based on the signals shown in the upper side of FIG. 6 are shown in a lower side of FIG. 6.

Referring to FIG. 6, the gate-on voltages are continuously generated when the operation of the second stage group starts after the operation of the first stage group is terminated.

The gate-on voltages shown in FIG. 6 are divided into the first stage group and the second stage group, and the divided gate-on voltages are shown in FIG. 7.

Referring to FIG. 7, the gate-on voltages are also continuously generated when the operation of the second stage group starts after the operation of the first stage group is terminated.

According to aspects of the present invention, the division of the pair of clock signals CKV1 and CKVB1, and CKV2 and CKVB2 having the same cycle reduces power consumption of the driving the gate driver.

The power consumption is indicated by Equation 1.

$$P=V*I=V*(CV/T)=C*f*V^2 \quad \text{[Equation 1]}$$

Herein, P is a power, V is voltage, I is current, C is capacitance, T is a cycle of 2*H, and f(=1/T) is frequency. The frequency f=½H when the gate on time is 1H as shown in e.g., FIG. 4. For example, for the graphics display resolution of Wide Extended Graphics Array (WXGA), the number of gate lines including vertical blank may be 840. In this configuration, 1H time duration for 60 Hz frequency equals to 1/(f*840)=1/(60*840)=19.8 μs, and frequency for CKV and CKVB is 1/(2*19.8 μs)=25.2 kHz. The Capacitance C may vary according to parameters, such as a resolution, Thin-Film-Transistor (TFT) size, and the like. The voltage V may be high to low voltage (peak-to-peak voltage) of a pair of clock signals CKV and CKVB. If the high voltage is Von voltage generated when the voltage of the CKV or CKVB is applied and the low voltage is Voff voltage when the voltage of the CKV or CKVB is not applied, the voltage V=Von-Voff. In Equation 1, Equation 2 is used for current conversion.

$$Q=C*V=I*T \quad \text{[Equation 2]}$$

Herein, Q is a charge amount.

Hereinafter, theoretical consumption powers are compared in a comparative example in which a clock signal applied to a stage is continuously swung and a test example in which the clock signals are divided into two stage groups and are applied during a half frame as shown in FIG. 3. The comparison result is shown in Table 1.

TABLE 1

| Item | | front | back | average | Total |
|---|---|---|---|---|---|
| Comparative | CKV | $C * f * V_{-}^2$ | $C * f * V_{-}^2$ | $C * f * V_{-}^2$ | $2C * f * V_{-}^2$ |
| Example | CKVB | $C * f * V_{-}^2$ | $C * f * V_{-}^2$ | $C * f * V_{-}^2$ | |
| Test | CKV1 | $C/2 * f * V_{-}^2$ | 0 | $C/4 * f * V_{-}^2$ | |
| Example | CKVB1 | $C/2 * f * V_{-}^2$ | 0 | $C/4 * f * V_{-}^2$ | $C * f * V_{-}^2$ |
| (FIG. 3) | CKV2 | 0 | $C/2 * f * V_{-}^2$ | $C/4 * f * V_{-}^2$ | |
| | CKVB2 | 0 | $C/2 * f * V_{-}^2$ | $C/4 * f * V_{-}^2$ | |

In Table 1, one display panel is divided into a front section and a back section, to which a clock signal CKV and a clock-bar signal CKVB are respectively applied.

First, in the comparative example, the clock signals CKV and CKVB are applied in all stages, and thus the power is always consumed.

In contrast, in the test example of FIG. 3, no clock signal is applied during about a half frame for each stage group, and thus the power consumption is 0 in the corresponding half frame. Further, as shown in FIG. 2, the number of the stages connected to each clock signal is reduced by half in comparison with the number of the stages connected to each clock signal in the comparative example. As a result, the result shown in Table 1 is obtained, and the total power consumption is reduced by half in comparison with the total power consumption in the comparative example.

Further, since the clock signal is not swung during a time period (e.g., about a half time in the exemplary embodiment of FIG. 3) in one frame, the average frequency of the clock signal is reduced by half. In other words, since the clock frequency of one frame is reduced by half in comparison with the frequency in the comparative example, the power is reduced by half.

Hitherto, it has been described that the power consumption is reduced when clock signals are divided into two stage groups as shown in FIG. 3.

Hereinafter, various exemplary embodiments of the present invention will be described.

First, an exemplary embodiment of the present invention illustrated in FIG. 8 will be described.

Figure 8:
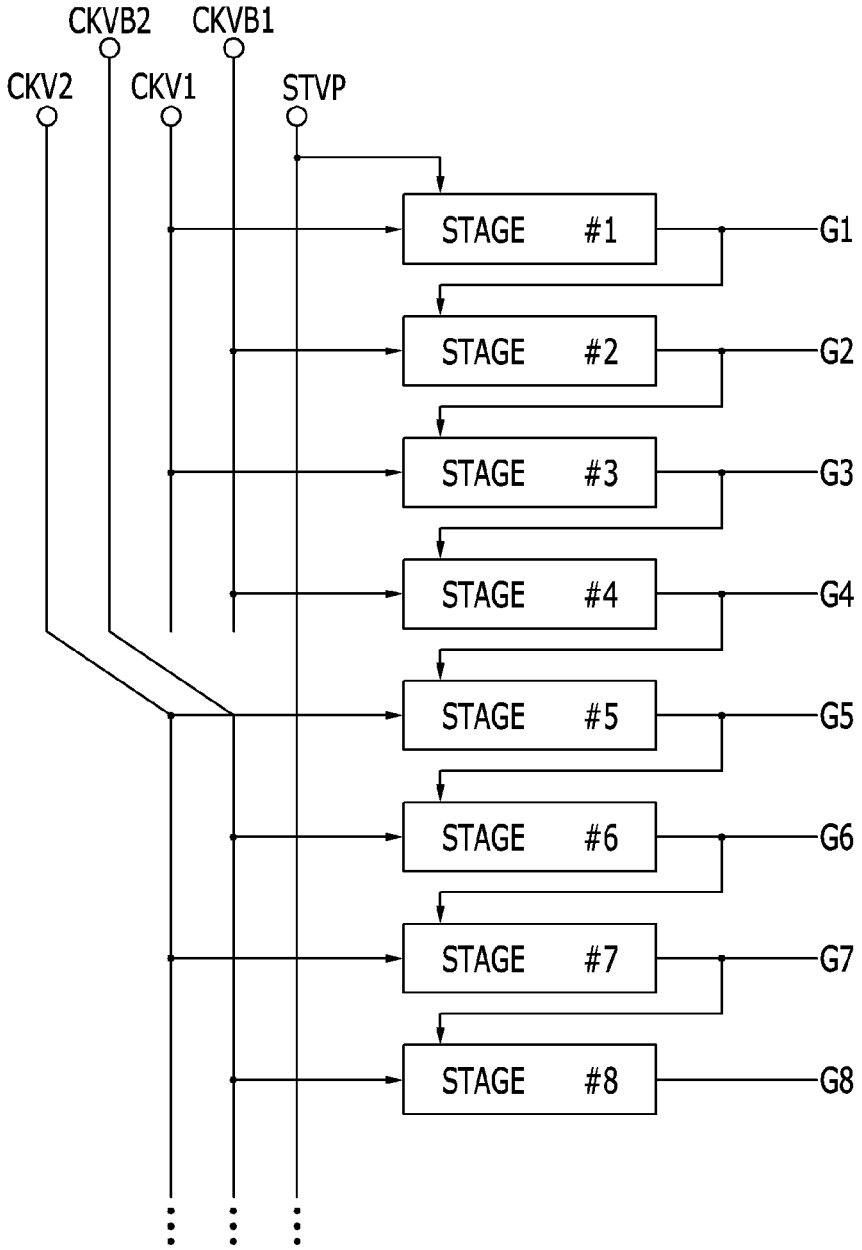
FIG. 8 is a block diagram showing a gate driver and a gate line according to an exemplary embodiment of the present invention.

FIG. 8 is a block diagram showing a gate driver and a gate line according to an exemplary embodiment of the present invention.

In the exemplary embodiment illustrated in FIG. 8, the lengths of the lines for the pair of first clock signals CKV1 and CKVB1 are shorter than the lengths of the lines for the pair of first clock signals CKV1 and CKVB1 shown in the exemplary embodiment illustrated in FIG. 2. In the exemplary embodiment of FIG. 8, it may not be necessary to extend the lines to which the pair of first clock signals CKV1 and CKVB1 is applied to the portion at which the second stage group is located. Accordingly, the extended parts of the lines are removed and the current loss may be reduced.

The signals shown in FIG. 3 are applied in the exemplary embodiment of FIG. 2 and the exemplary embodiment of FIG. 8. Specifically, for each stage, the clock signals remain constant without a swing during a half frame. According to the configuration of FIG. 2 and FIG. 8, the first stage group is operated during a first half frame, and the second stage group is operated during a second half frame. The number of the stages belonging to the first stage group is the same as the number of the stages belonging to the second stage group.

However, the time period during which the clock signal is constant without a swing may be variously determined in accordance with other exemplary embodiments of the present invention. It will be described with reference to FIG. 9 to FIG. 12.

First, a configuration in which the number of stages in the first stage group is greater than the number of stages in the second stage group will be described with reference to FIG. 9 and FIG. 10. In this case, in one frame, a first time period during which the first clock signals CKV1 and CKVB1 are not swung is shorter than a second time period during which the second clock signals CKV2 and CKVB2 are not swung.

Figure 9:
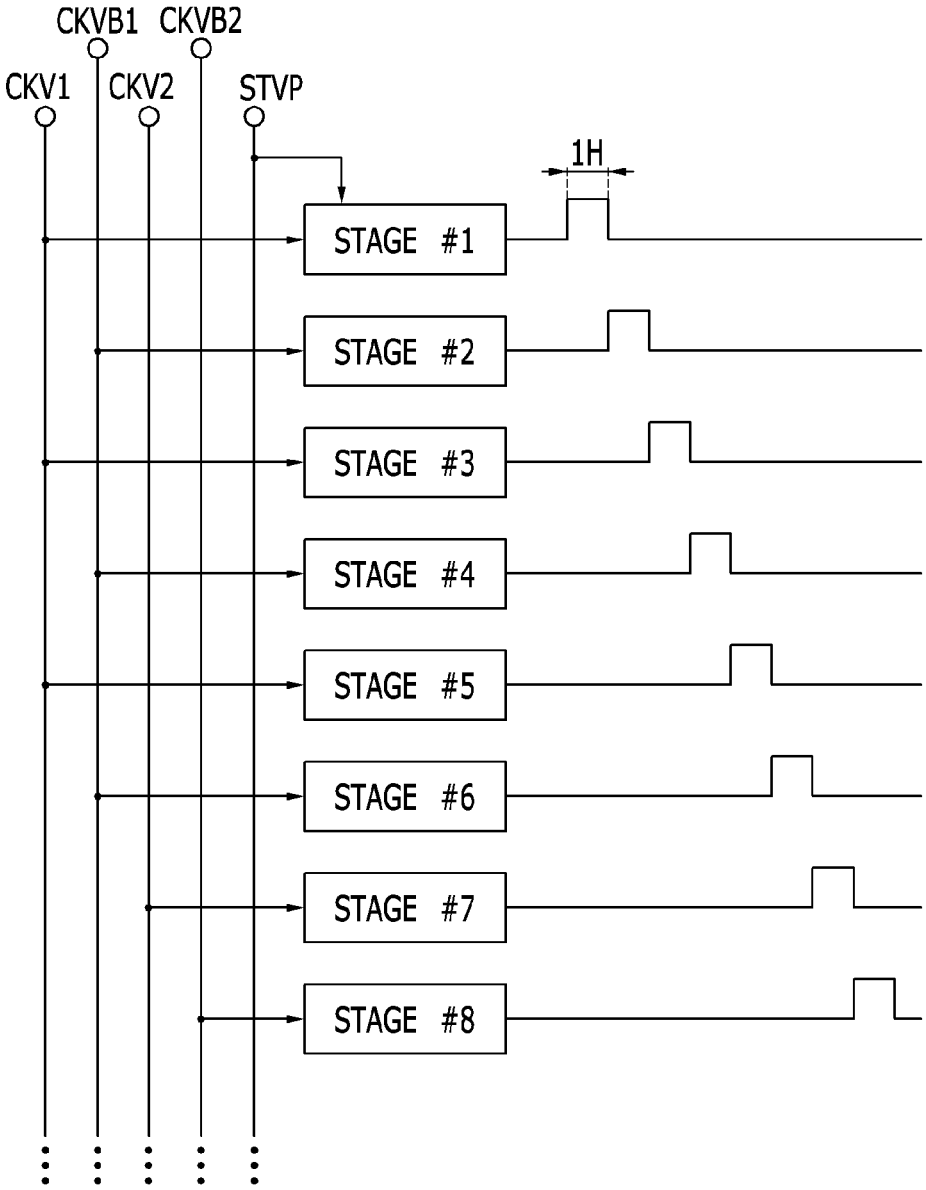
FIG. 9 and FIG. 10 show a structure of a gate driver and waveforms applied thereto according to an exemplary embodiment of the present invention.
Figure 10:
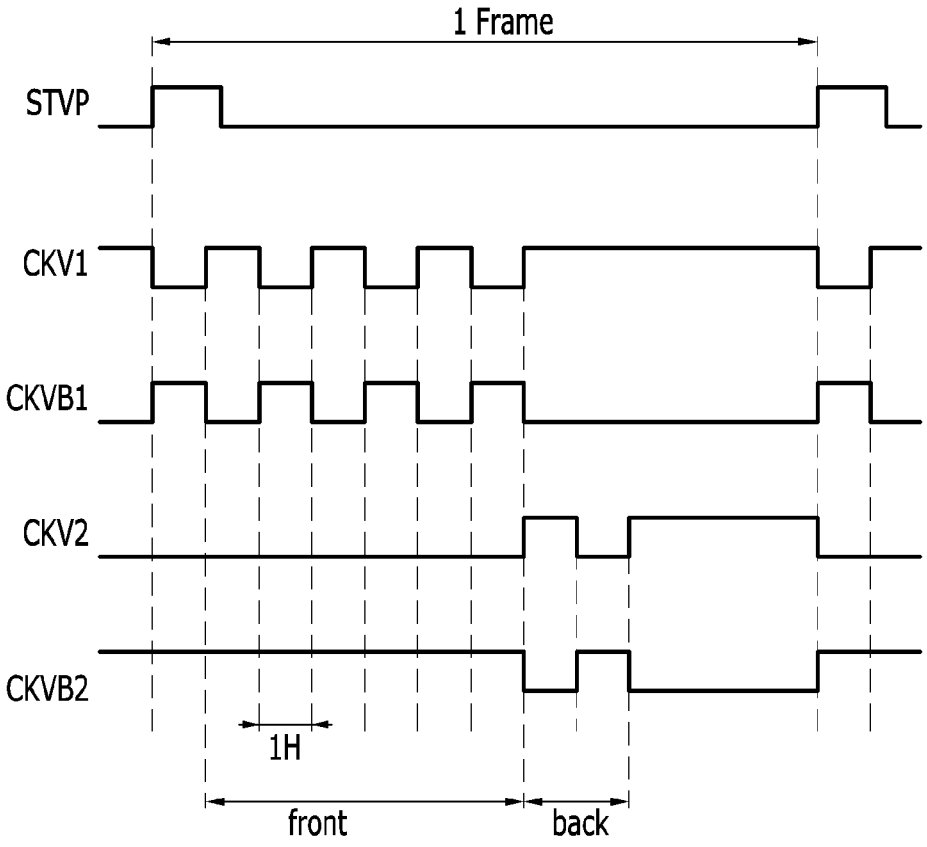

FIG. 9 and FIG. 10 show a structure of the gate driver and waveforms applied thereto according to an exemplary embodiment of the present invention.

Referring to FIG. 9, the pair of first clock signals CKV1 and CKVB1 is applied to 6 stages of a total of 8 stages, and the pair of second clock signals CKV2 and CKVB2 is applied to the other 2 stages among the 8 stages, unlike the configuration shown in FIG. 2.

For the first clock signals CKV1 and CKVB1, the clock signals may be applied until the 6 stages sequentially output gate-on voltages in order to drive the 6 stages in the first group. For the pair of second clock signals CKV2 and CKVB2, the clock signals may be applied until the 2 stages sequentially output gate-on voltages in order to drive the other 2 stages. As a result, as shown in FIG. 10, in one frame, the first time period during which the first clock signals CKV1 and CKVB1 are not swung is shorter than the second time period during which the second clock signals CKV2 and CKVB2 are not swung.

Next, a configuration in which the number of the stages in the second stage group is greater than the number of stages in the first stage group will be described with reference to FIG. 11 and FIG. 12

In this case, in one frame, the first time period during which the first clock signals CKV1 and CKVB1 are not swung is longer than the second time period during which the second clock signals CKV2 and CKVB2 are not swung.

Figure 11:
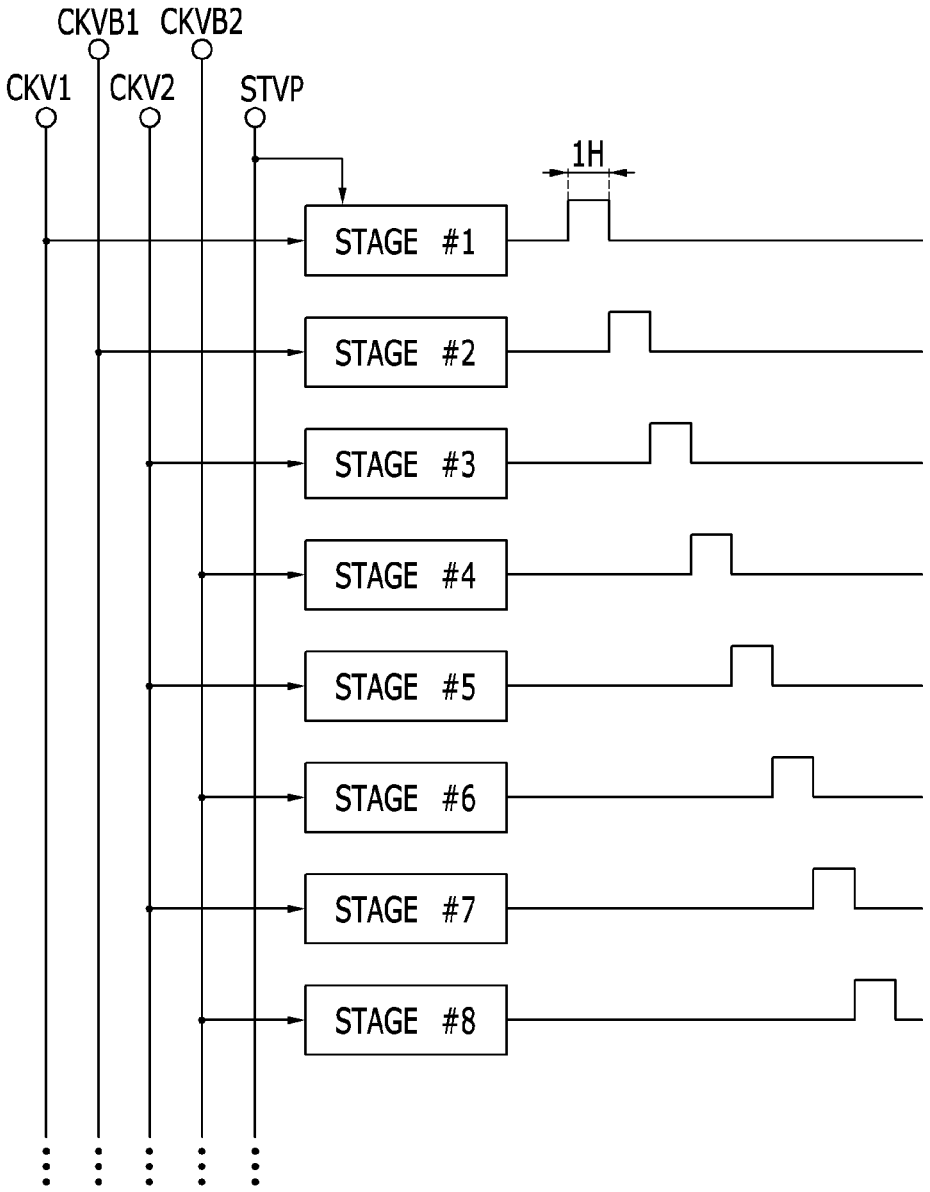
FIG. 11 and FIG. 12 show a structure of a gate driver and waveforms applied thereto according to an exemplary embodiment of the present invention.
Figure 12:
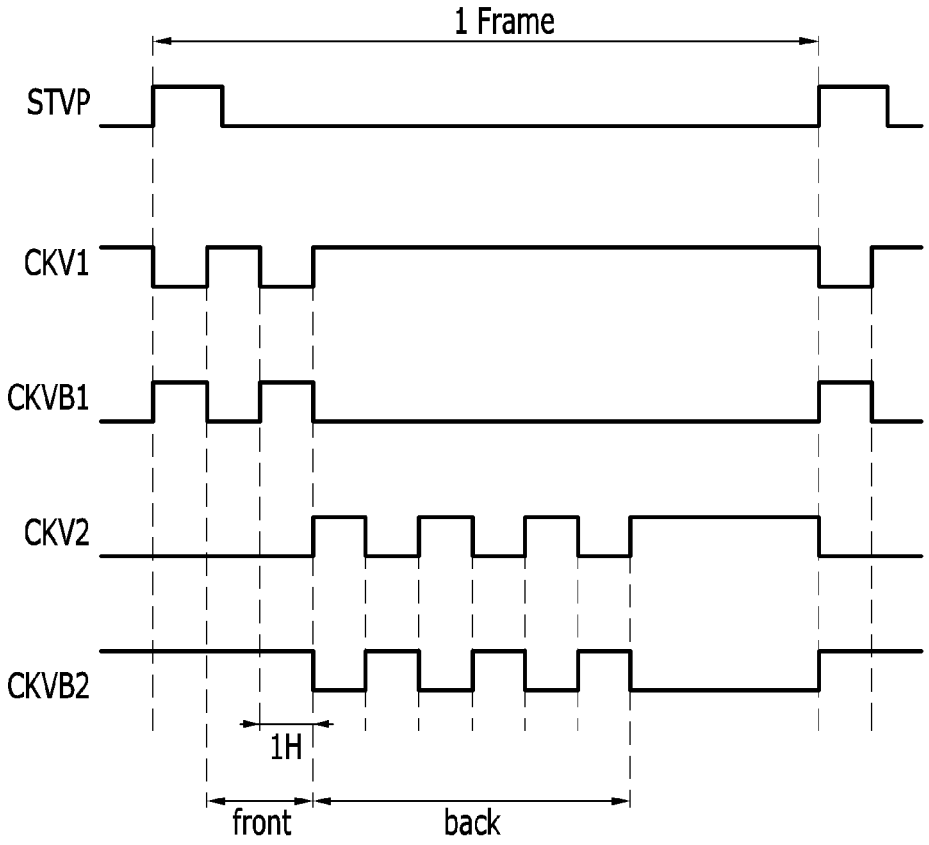

FIG. 11 and FIG. 12 show a structure of the gate driver and waveforms applied thereto according to an exemplary embodiment of the present invention.

Referring to FIG. 11, the pair of first clock signals CKV1 and CKVB1 is applied to 2 stages of a total of 8 stages, and the pair of second clock signals CKV2 and CKVB2 is applied to the other 6 stages of the 8 stages, unlike the configuration shown in FIG. 2.

For the first clock signals CKV1 and CKVB1, the clock signals may be applied until the 2 stages sequentially output gate-on voltages in order to drive the 2 stages in the first stage group. For the pair of second clock signals CKV2 and CKVB2, the clock signals may be applied until the other 6 stages sequentially output gate-on voltages in order to drive the 6 stages in the second stage group. As a result, as shown in FIG. 12, in one frame, the first time period during which the first clock signals CKV1 and CKVB1 are not swung is longer than the second time period during which the second clock signals CKV2 and CKVB2 are not swung.

Referring to FIG. 9 to FIG. 12, if the pair of first clock signals has a first section in which the clock signal is applied and a second section in which no swing is performed, and the pair of second clock signals has a first section in which the clock signal is applied and a second section in which no swing is performed, the size of the first section in which the clock signal is applied is proportional to the number of stages belonging to the corresponding stage group. In this case, the second section in which no swing is performed is inversely proportional to the number of the stages belonging to the stage group.

The first section in which the clock signal is applied in the pair of first clock signals CKV1 and CKVB1 is not overlapped with the first section in which the clock signal is applied in the pair of second clock signals CKV2 and CKVB2.

Moreover, the clock signal frequency of the first section in which the clock signal is applied in the pair of the first clock signals is the same as that of the first section in which the clock signal is applied in the pair of the second clock signals.

Hitherto, the structure in which the first stage group is connected to gate lines of the front part and the second stage group is connected to gate lines of the back part has been described. As a result, only one first stage group and only one second stage group exist in a gate driver 500.

According to other aspects of the present invention, a gate driver may include stages of the first stage group and stages of the second stage group that are alternately arranged. In other words, the stages belonging to the first stage group and the second stage group may be alternately disposed.

Figure 13:
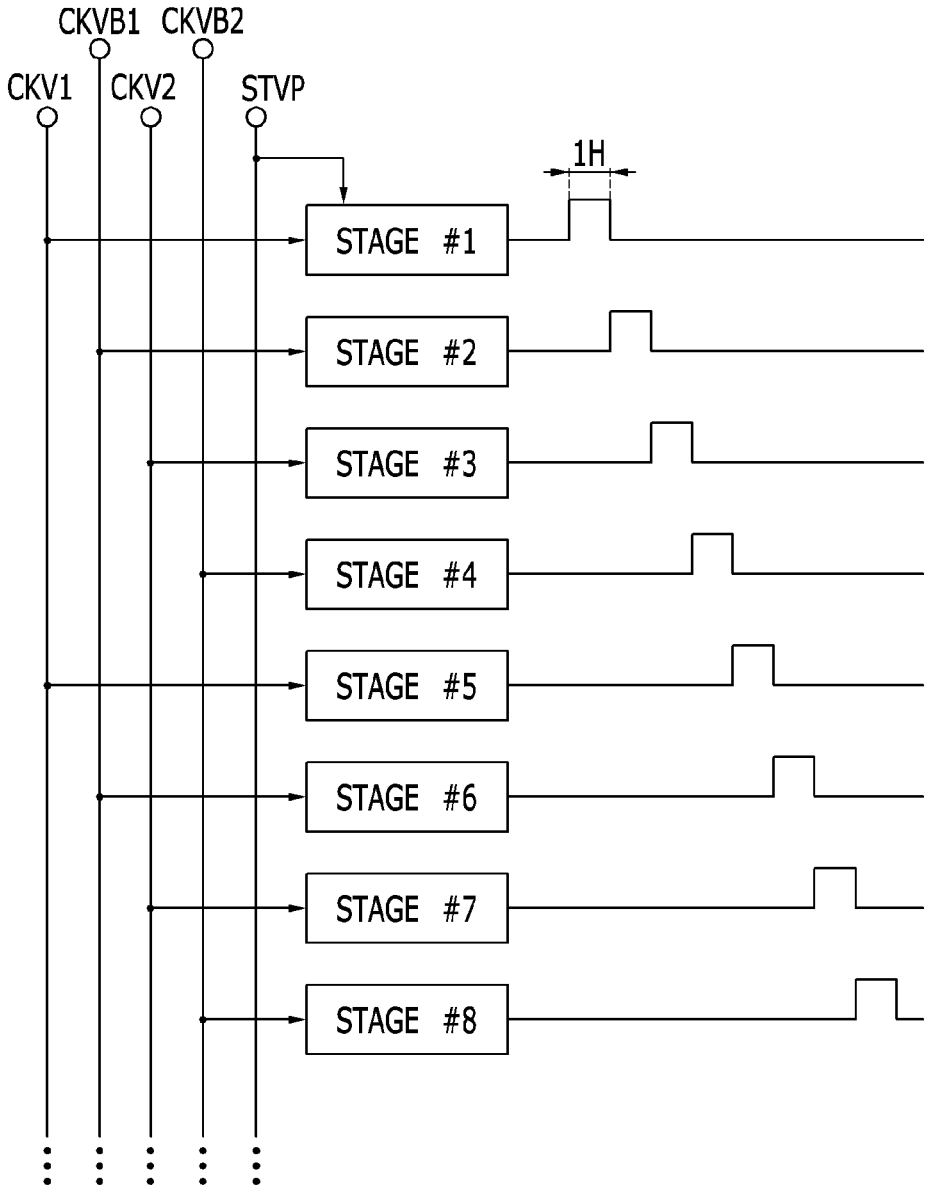
FIG. 13 and FIG. 14 show a structure of a gate driver and waveforms applied thereto according to an exemplary embodiment of the present invention.
Figure 14:
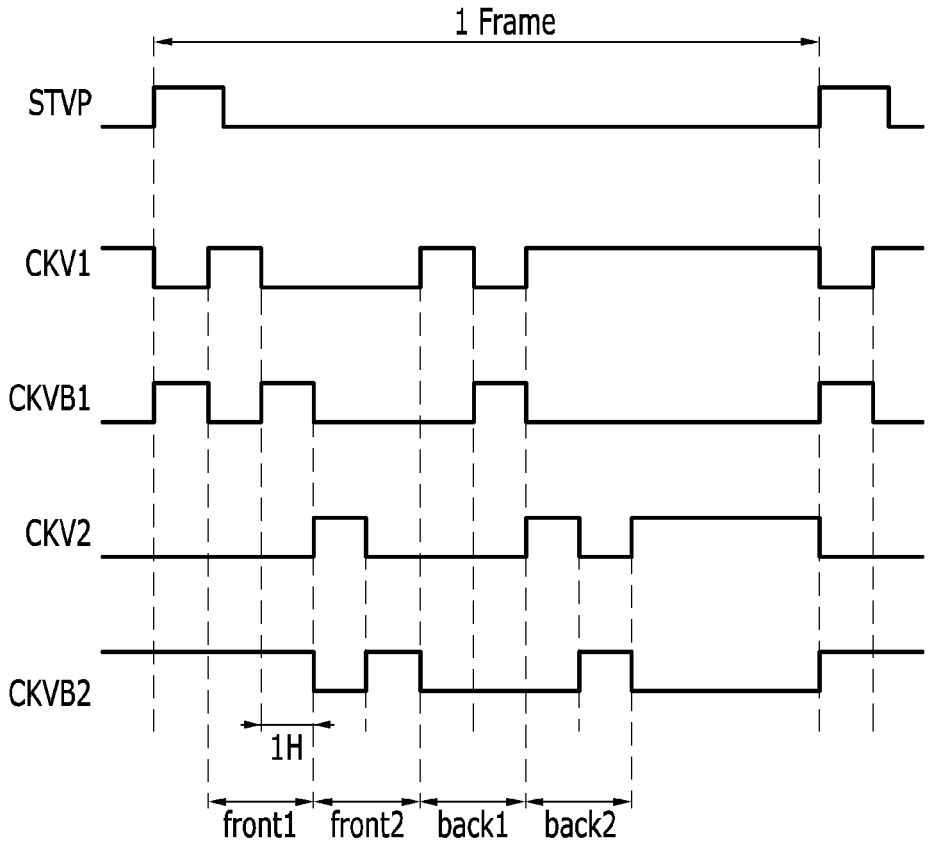

FIG. 13 and FIG. 14 show a structure of the gate driver and waveforms applied thereto according to an exemplary embodiment of the present invention.

In the exemplary embodiment of FIG. 13, a first stage, a second stage, a fifth stage, and a sixth stage of a total of 8 stages belong to the first stage group, and a third stage, a fourth stage, a seventh stage, and an eighth stage belong to the second stage group.

For the pair of first clock signals CKV1 and CKVB1, the clock signal is applied to the separately located four stages (first, second, fifth, and sixth stage) so as to output the gate-on voltages, and no swing is performed during a second time period other than a first time period during which the clock signal is applied. For the pair of second clock signals CKV2 and CKVB2, the clock signal is applied to the separately located four stages (third, fourth, seventh, and eighth stage) so as to output the gate-on voltages, and no swing is performed during a second time period other than a first time period during which the clock signal is applied. As shown in FIG. 13 and FIG. 14, the first time period in which the pair of the first clock signals CKV1 and CKVB1 is applied is not overlapped with the first time period in which the pair of the second clock signals CKV2 and CKVB2 is applied. As a result, the clock signals shown in FIG. 14 may be applied. In other words, one clock signal has two sections in which no swing is performed in one frame.

In the exemplary embodiment of FIG. 14, the length of the time period during which the first clock signals CKV1 and CKVB1 are not swung is substantially the same as the length of the time period during which the pair of second clock signals CKV2 and CKVB2 are not swung.

However, unlike in the exemplary embodiment of FIG. 14, the time period during which the first clock signals CKV1 and CKVB1 are not swung may be different from the time period during which the pair of second clock signals CKV2 and CKVB2 are not swung even in a configuration having two or more sections in which no swing is performed.

Further, the number of the sections in which the first clock signals CKV1 and CKVB1 are not swung may be different from the number of the sections in which the pair of second clock signals CKV2 and CKVB2 is not swung. For example, the number of the sections in which the first clock signals CKV1 and CKVB1 are not swung may be one, while the number of the sections in which the pair of second clock signals CKV2 and CKVB2 is not swung may be two. In this case, the stages belonging to the first stage group may be separated located (e.g., stage 1, stage 2, stage 7, and stage 8), while the stages belonging to the second stage group may be continuously located (e.g., stage 3, stage 4, stage 5, and stage 6).

In the exemplary embodiment of FIG. 14, the first clock signals of the pair of first clock signals have first sections in which the clock signal is applied and second sections in which no swing is performed, and the second clock signals of the pair of second clock signals have first sections in which the clock signal is applied and second sections in which no swing is performed. For the pair of the first clock signals or the pair of the second clock signals, the second section in which no swing is performed is located between the first sections in which the clock signal is applied in one frame.

Hitherto, the exemplary embodiments in which the two pairs of clock signals are used have been described.

Hereinafter, a configuration in which three pairs of clock signals are used will be described with reference to FIG. 15 and FIG. 16.

Figure 15:
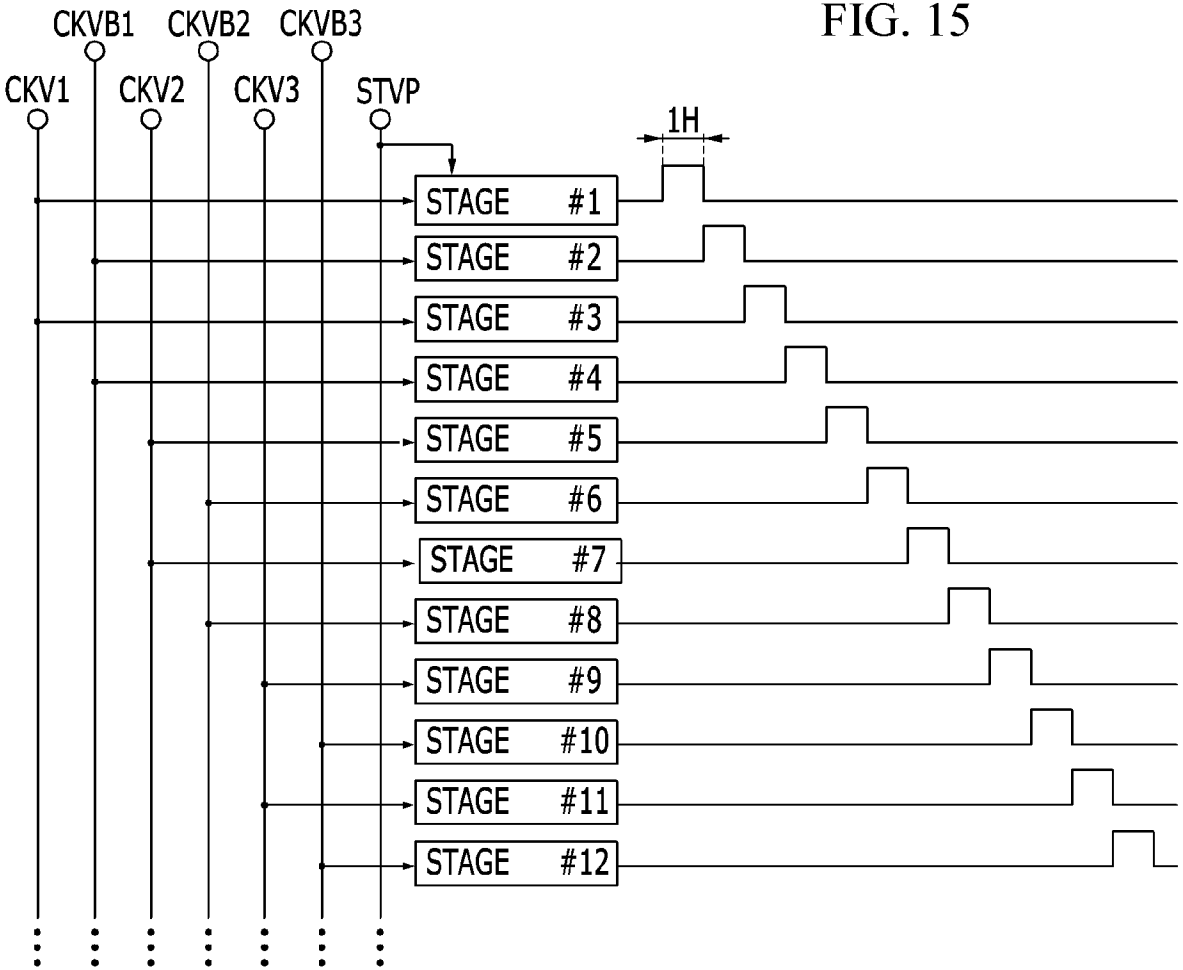
FIG. 15 and FIG. 16 show a structure of a gate driver and waveforms applied thereto according to an exemplary embodiment of the present invention.
Figure 16:
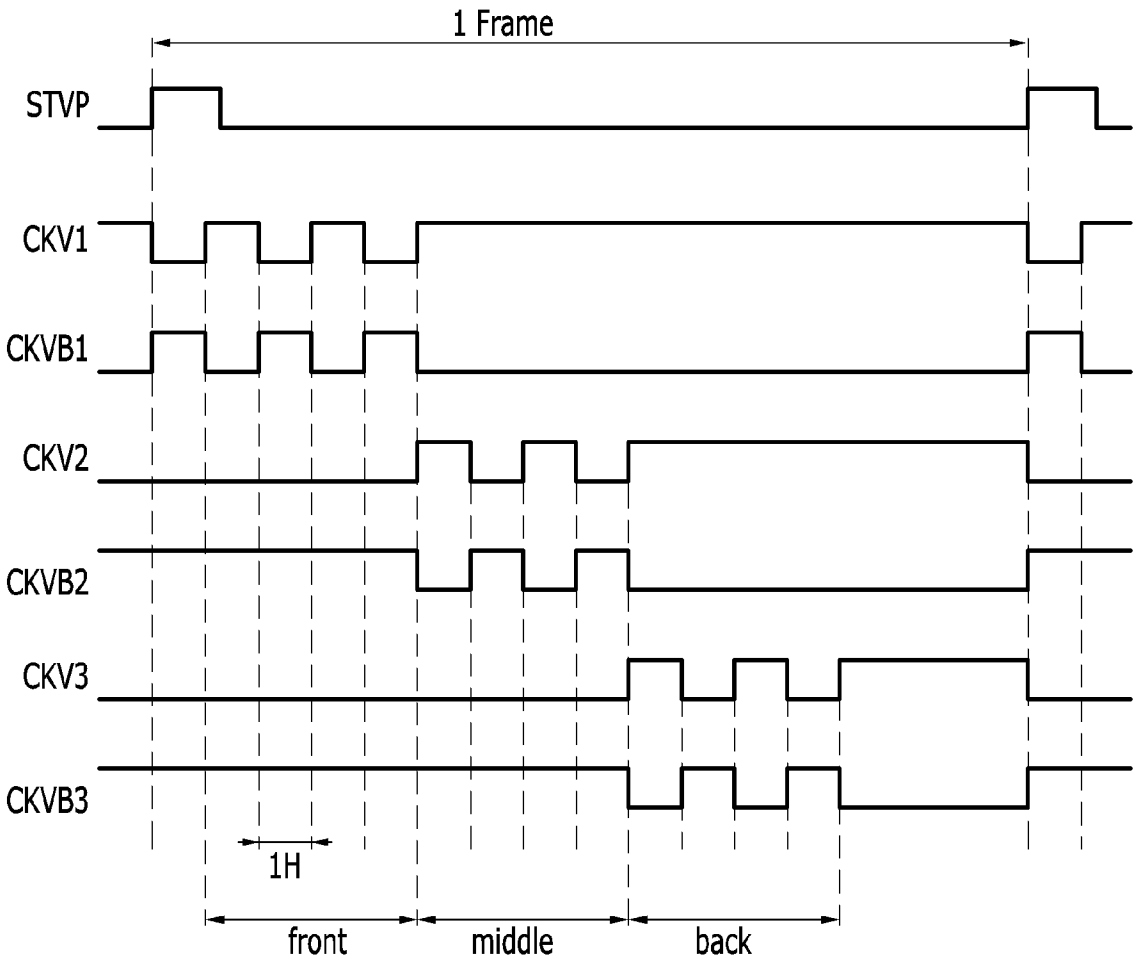

FIG. 15 and FIG. 16 show a structure of the gate driver and waveforms applied thereto according to an exemplary embodiment of the present exemplary embodiment.

The gate driver 500 shown in FIG. 15 includes a plurality of stages STAGE #1, STAGE #2, STAGE #3, STAGE #4, . . . , STAGE #N that are dependently connected to each other. Like in the exemplary embodiment of FIG. 2, each of the stages STAGE #1, STAGE #2, STAGE #3, STAGE #4, . . . includes one input terminal (STVP or a terminal into which the output of the previous stage is inputted) and one clock input terminal (one terminal of CKV1, CKVB1, CKV2, CKVB2, CKV3, and CKVB3 into which one clock signal is inputted). Each of the stages STAGE #1, STAGE #2, STAGE #3, STAGE #4, . . . , STAGE #N may further include a terminal (not shown) into which the low voltage Vss1 corresponding to the gate-off voltage is inputted. Further, each stage STAGE #1, STAGE #2, STAGE #3, STAGE #4, . . . , STAGE #N includes a gate voltage output terminal for outputting a gate voltage. In accordance with another exemplary embodiment of the present invention, each stage STAGE #1, STAGE #2, STAGE #3, STAGE #4, . . . , STAGE #N may further include an output terminal for outputting a transfer signal corresponding to the gate voltage or for outputting an output signal of an inverter included in a stage to the outside. The inverter may invert the input of the inverter to generate an inverted output signal.

The stages STAGE #1, STAGE #2, STAGE #3, STAGE #4, . . . , STAGE #N are connected to the gate lines one by one, and the output of each stage is applied as a gate voltage.

An operation of each stage STAGE #1, STAGE #2, STAGE #3, STAGE #4, . . . , STAGE #N is started by a signal inputted through the input terminal, and a high-level gate-on voltage is generated through a boost-up operation according to an inputted clock signal. Herein, the signal inputted through the input terminal is a gate voltage of the previous stage. However, the first stage STAGE #1 receives a scan start signal STVP since the previous stage thereof does not exist. As a result, the gate driver 500 sequentially outputs gate-on voltages by the scan start signal STVP.

The pair of first clock signals CKV1 and CKVB1, the pair of second clock signals CKV2 and CKVB2, and the pair of third clock signals CKV3 and CKVB3 may be applied to stages STAGE #1, STAGE #2, STAGE #3, STAGE #4, . . . , STAGE #N as shown in FIG. 15. According to such a configuration, the stages STAGE #1, STAGE #2, STAGE #3, STAGE #4, . . . , STAGE #N are divided into a first stage group to which the pair of first clock signals CKV1 and CKVB1 is applied, a second stage group to which the pair of second clock signals CKV2 and CKVB2 is applied, and a third stage group to which the pair of third clock signals CKV3 and CKVB3 is applied.

In the exemplary embodiment of FIG. 15, only 12 stages are shown, but aspects are not limited as such. The first stage to the fourth stage belong to the first stage group, the fifth stage to the eighth stage belong to the second stage group, and the ninth stage to the twelfth stage belong to the third stage group. The total gate lines may be divided into three groups as shown in FIG. 15 or more groups. The stages connected to a front group of gate lines belong to the first stage group, the stages connected to a second group of gate lines belong to the second stage group, and the stages connected to a third group of gate lines belong to the third stage group. In accordance with the exemplary embodiment of FIG. 15, if a total of 1080 gate lines are provided, 360 stages, 360 stages, and 360 stages may respectively belong to the first stage group, the second stage group, and the third stage group.

As shown in FIG. 15, two clock signals (a clock signal and a clock-bar signal) of the pair of first clock signals CKV1 and CKVB1 are alternately applied to the 4 stages belonging to the first stage group. Specifically, the clock signal CKV1, the clock-bar signal CKVB1, the clock signal CKV1, and the clock-bar signal CKVB1 are respectively applied to the first stage, the second stage, the third stage, and the fourth stage.

Herein, the clock signal CKV1 and the clock-bar signal CKVB1 may have inverted phases, and may have constant voltage levels which are not swung during a certain time period within one frame.

Two clock signals of the pair of second clock signals CKV2 and CKVB2 are alternately applied to the 4 stages belonging to the second stage group. Specifically, the clock signal CKV2, the clock-bar signal CKVB2, the clock signal CKV2, and the clock-bar signal CKVB2 are respectively applied to the fifth stage, the sixth stage, the seventh stage, and the eighth stage.

Herein, the clock signal CKV2 and the clock-bar signal CKVB2 may have inverted phases, and may have constant voltage levels which are not swung during a certain time period within one frame.

Two clock signals of the pair of third clock signals CKV3 and CKVB3 are alternately applied to the 4 stages belonging to the third stage group. Specifically, the clock signal CKV3, the clock-bar signal CKVB3, the clock signal CKV3, and the clock-bar signal CKVB3 are respectively applied to the ninth stage, the tenth stage, the eleventh stage, and the twelfth stage.

Herein, the clock signal CKV3 and the clock-bar signal CKVB3 may have inverted phases, and may have constant voltage levels which are not swung during a certain time period within one frame.

Hereinafter, waveforms of signals applied to the stages STAGE #1, STAGE #2, STAGE #3, STAGE #4, . . . , STAGE #N will be described with reference to FIG. 16.

In FIG. 16, the scan start signal STVP, the pair of first clock signals CKV1 and CKVB1, the pair of second clock signals CKV2 and CKVB2, and the pair of third clock signals CKV3 and CKVB3 are shown.

The scan start signal STVP is applied to the first stage one time to start the operation of the gate driver 500.

As shown in FIG. 16, the pair of first clock signals CKV1 and CKVB1, the pair of second clock signals CKV2 and CKVB2, and the pair of third clock signals CKV3 and CKVB3 have a constant voltage level which is not swung during a certain time period within one frame. In the exemplary embodiment of FIG. 16, the pair of first clock signals CKV1 and CKVB1, the pair of second clock signals CKV2 and CKVB2, and the pair of third clock signals CKV3 and CKVB3 are swung during a certain time period within one frame, but are not swung during the remaining time period in one frame. For example, each of the pair of first clock signals CKV1 and CKVB1, the pair of second clock signals CKV2 and CKVB2, and the pair of third clock signals CKV3 and CKVB3 is swung during about a ⅓ frame, but are not swung during about the remaining ⅔ frame. Further, the pair of first clock signals CKV1 and CKVB1, the pair of second clock signals CKV2 and CKVB2, and the pair of third clock signals CKV3 and CKVB3 are not overlapped with each other and have the same cycle. In other words, if the pair of first clock signals CKV1 and CKVB1, the pair of second clock signals CKV2 and CKVB2, and the pair of third clock signals CKV3 and CKVB3 are summed, one signal having a constant cycle (a clock signal having a constant frequency except the inactive time period at the end of one frame) may be recovered.

In FIG. 16, a first period during which the first stage group is operated by receiving the pair of first clock signals CKV1 and CKVB1 is marked as "front" representing a front section, a second period during which the second stage group is operated by receiving second clock signals CKV2 and CKVB2 is marked as "middle" representing a middle section, and a third period during which the third stage group is operated by receiving third clock signals CKV3 and CKVB3 is marked as "back" representing a back section. In the exemplary embodiment of FIG. 16, each of the front section, the middle section, and the back section occupies about a ⅓ frame.

In FIG. 15 and FIG. 16, the number of the stages belonging to the first stage group, the number of the stages belonging to the second stage group, and the number of the stages belonging to the third stage group are the same.

Further, the pair of first clock signals has a first section in which the clock signal is applied and a second section in which no swing is performed, the pair of second clock signals has a first section in which the clock signal is applied and a second section in which no swing is performed, and the pair of third clock signals has a first section in which the clock signal is applied and a second section in which no swing is performed. The first sections in which the clock signal is applied in the pair of first clock signals, the pair of second clock signals, and the pair of third clock signals are not overlapped with each other.

Hereinafter, outputs of a gate-on voltage of the gate driver 500 to which these signals are applied will be described.

First, the first stage STAGE #1 receives the clock signal CKV1 supplied from the outside through the clock input terminal of the first stage and the scan start signal STVP through the input terminal of the first stage, and outputs a gate-on voltage to the first gate line G1 through the gate voltage output terminal of the first stage. In this case, the outputted gate-on voltage is transferred to or fed into the input terminal of the second stage STAGE #2 (not illustrated in FIG. 15). In accordance with another exemplary embodiment of the present invention, a transfer signal corresponding to the gate-on voltage may be transferred to or fed into the second stage STAGE #2.

The second stage STAGE #2 receives the clock-bar signal CKVB1 supplied from the outside through the clock input terminal of the second stage and the gate-on voltage of the first stage STAGE #1 through the input terminal of the second stage, and outputs a gate-on voltage to the second gate line G2 through the gate voltage output terminal of the second stage. In this case, the outputted gate-on voltage is transferred to or fed into the input terminal of the third stage STAGE #3 (not illustrated in FIG. 15). In accordance with another exemplary embodiment of the present invention, a transfer signal corresponding to the gate-on voltage may be transferred to or fed into the third stage STAGE #3.

These operations are repeated until the last stage (e.g., the fourth stage in FIG. 15) belonging to the first stage group generates and outputs a gate-on voltage. The gate-on voltage outputted from the fourth stage STAGE #4 is transferred to or fed into the input terminal of the fifth stage STAGE #5 (not illustrated in FIG. 15). In accordance with another exemplary embodiment of the present invention, a transfer signal corresponding to the gate-on voltage may be transferred to or fed into the fifth stage STAGE #5.

The fifth stage STAGE #5 belonging to the second stage group receives the clock signal CKV2 supplied from the outside through the clock input terminal of the fifth stage and the gate-on voltage of the fourth stage STAGE #4 through the input terminal of the fifth stage, and outputs a gate-on voltage to the fifth gate line G5 through the gate voltage output terminal of the fifth stage. In this case, the outputted gate-on voltage is transferred to or fed into the input terminal of the sixth stage STAGE #6. In accordance with another exemplary embodiment of the present invention, a transfer signal corresponding to the gate-on voltage may be transferred to or fed into the sixth stage STAGE #6.

The sixth stage STAGE #6 receives the clock-bar signal CKVB2 supplied from the outside through the clock input terminal of the sixth stage and the gate-on voltage of the fifth stage STAGE #5 through the input terminal of the sixth stage, and outputs a gate-on voltage to the seventh gate line G7 through the gate voltage output terminal of the sixth stage. In this case, the outputted gate-on voltage is transferred to or fed into the input terminal of the seventh stage STAGE #7. In accordance with another exemplary embodiment of the present invention, a transfer signal corresponding to the gate-on voltage may be transferred to or fed into the seventh stage STAGE #7.

These operations are repeated until the last stage (e.g., the eighth stage in FIG. 15) belonging to the second stage group generates and outputs a gate-on voltage. In this case, the outputted gate-on voltage outputted from the eighth stage STAGE #8 is transferred to or fed into the input terminal of the ninth stage STAGE #9 belonging to the third stage group. In accordance with another exemplary embodiment of the present invention, a transfer signal corresponding to the gate-on voltage may be transferred to or fed into the ninth stage STAGE #9.

The ninth stage STAGE #9 belonging to the third stage group receives the clock signal CKV3 supplied from the outside through the clock input terminal of the ninth stage and the gate-on voltage of the eighth stage STAGE #8 through the input terminal of the ninth stage, and outputs a gate-on voltage to the ninth gate line G9 through the gate voltage output terminal of the ninth stage.

In this case, the outputted gate-on voltage of the ninth stage is transferred to or fed into the input terminal of the tenth stage STAGE #10. In accordance with another exemplary embodiment of the present invention, a transfer signal corresponding to the gate-on voltage may be transferred to or fed into the input terminal of the tenth stage STAGE #10.

The tenth stage STAGE #10 receives the clock-bar signal CKVB3 supplied from the outside through the clock input terminal of the tenth stage and the gate-on voltage of the ninth stage STAGE #9 through the input terminal of the tenth stage, and outputs a gate-on voltage to the tenth gate line G10 through the gate voltage output terminal of the tenth stage. In this case, the outputted gate-on voltage is transferred to or fed into the input terminal of the eleventh stage STAGE #11. In accordance with another exemplary embodiment of the present invention, a transfer signal corresponding to the gate-on voltage may be transferred to or fed into the eleventh stage STAGE #11.

These operations are repeated until the last stage (e.g., the twelfth stage in FIG. 15) belonging to the third stage group generates and outputs a gate-on voltage As shown in FIG. 16, the timing of the gate-on voltage of the fifth stage belonging to the second stage group is determined as 1H directly next to the gate-on voltage of the fourth stage belonging to the first stage group. Further, the timing of the gate-on voltage of the ninth stage belonging to the third stage group is determined as 1H directly next to the gate-on voltage of the eighth stage belonging to the second stage group. This is because the pair of first clock signals CKV1 and CKVB1, the pair of second clock signals CKV2 and CKVB2, and the pair of third clock signals CKV3 and CKVB3 have the same cycle. If the clock signal CKV1 belonging to the pair of first clock signals CKV1 and CKVB1, the clock signal CKV2 belonging to the pair of second clock signals CKV2 and CKVB2, and the clock signal CKV3 belonging to the pair of third clock signals CKV3 and CKVB3 are summed, one clock signal having a matched phase is generated, and if the clock-bar signal CKVB1 belonging to the pair of first clock signals CKV1 and CKVB1, the clock-bar signal CKVB2 belonging to the pair of second clock signals CKV2 and CKVB2, and the clock signal CKVB3 belonging to the pair of third clock signals CKV3 and CKVB3 are summed, one clock signal having a matched phase is generated.

Accordingly, as shown in FIG. 15, the gate-on voltages of the first stage group, the second stage group, and the third stage group are sequentially outputted per every 1H.

Further, since each of the pair of first clock signals CKV1 and CKVB1, the pair of second clock signals CKV2 and CKVB2, and the pair of third clock signals CKV3 and CKVB3 has a second section in which no swing is performed, the frequency is reduced by the second section in which no swing is performed, thereby reducing the power consumption.

Hitherto, the exemplary embodiments in which one stage receives the output of the previous stage have been described. In accordance with another exemplary embodiment, one stage may also receive the output of another stage. This will be described with reference to FIG. 17 and FIG. 18.

Figure 17:
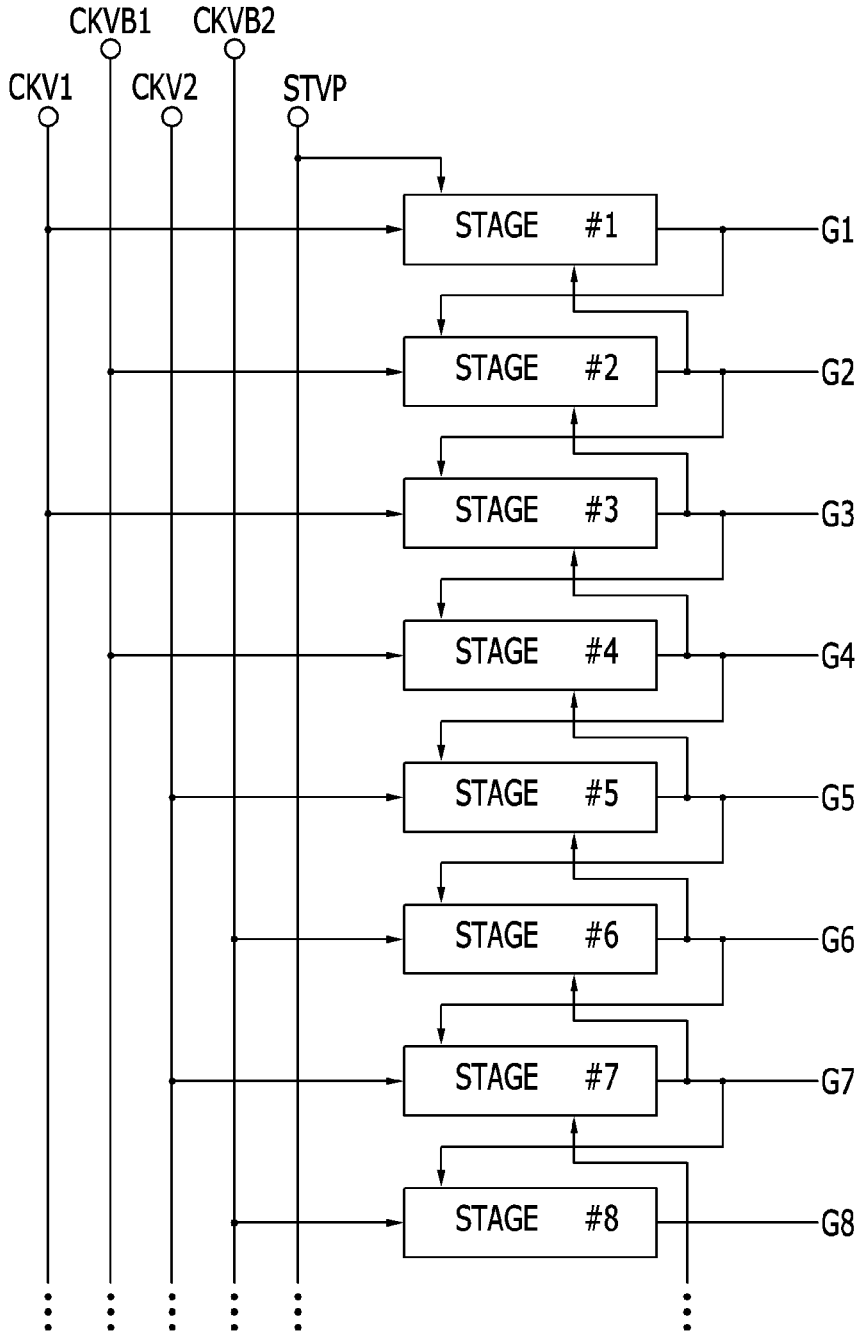
FIG. 17 and FIG. 18 are block diagrams showing a gate driver and a gate line according to an exemplary embodiment of the present invention.
Figure 18:
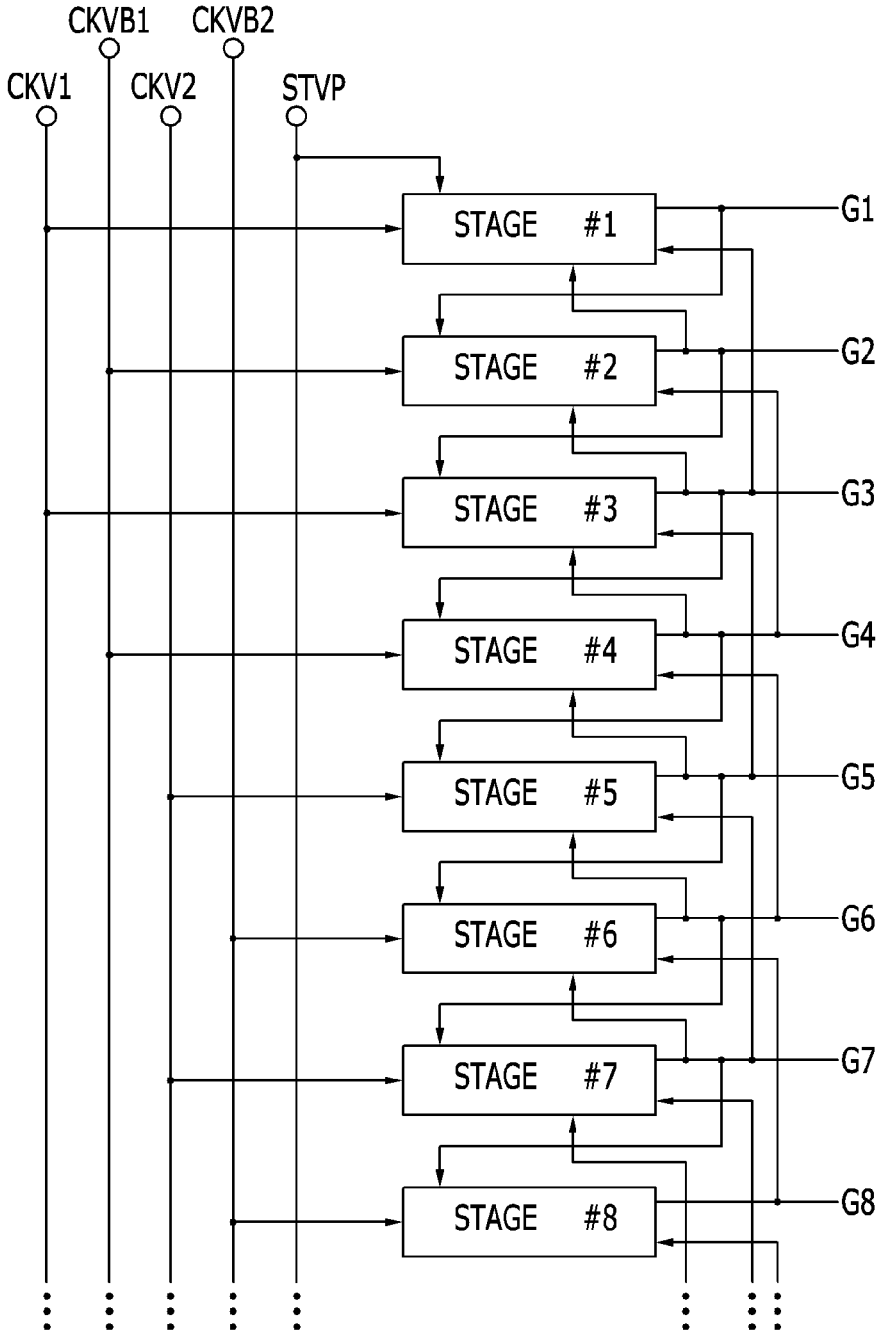

FIG. 17 and FIG. 18 are block diagrams showing a gate driver and a gate line according to an exemplary embodiment of the present invention.

First, in the exemplary embodiment of FIG. 17, one stage also receives the output of a subsequent stage. Further, the output of the present stage may be applied to or fed into an additional input terminal of the previous stage.

In accordance with the exemplary embodiment of FIG. 17, each of the stages STAGE #1, STAGE #2, STAGE #3, STAGE #4, . . . , STAGE #N includes one input terminal (STVP or a terminal into which an output of the previous stage is inputted) and one clock input terminal (one terminal into which one of CKV1, CKVB1, CKV2, and CKVB2 is inputted). Each of the stages STAGE #1, STAGE #2, STAGE #3, STAGE #4, . . . , STAGE #N may further include a terminal (not shown) into which the low voltage Vss1 corresponding to the gate-off voltage is inputted. Further, each stage STAGE #1, STAGE #2, STAGE #3, STAGE #4, . . . , STAGE #N includes a gate voltage output terminal for outputting a gate voltage. In accordance with another exemplary embodiment of the present invention, each of the stages STAGE #1, STAGE #2, STAGE #3, STAGE #4, . . . , STAGE #N may further include an output terminal for outputting a transfer signal corresponding to the gate voltage or for outputting an output signal of an inverter included in a stage to the outside. Instead of the gate voltage, the transfer signal may be transferred to or fed into a previous stage or a subsequent stage, not necessarily the previous or subsequent stages arranged next to the present stage.

The stages STAGE #1, STAGE #2, STAGE #3, STAGE #4, . . . , STAGE #N are connected to the gate lines one by one, and the output of each stage is applied as a gate voltage.

If the output is transferred from the subsequent stage to the present stage, the present stage may stop output of the gate-on signal or initialize a voltage charged in a node of the stage.

In the exemplary embodiment of FIG. 18, one stage (stage M) receives the output of a subsequent stage (stage M+1) and also receives the output of a stage after the subsequent stage (or referred to as "second subsequent stage", which is stage M+2). If the stage M+1 is viewed as the present stage, the output of the present stage is applied to a stage before the previous stage (or referred to as "second previous stage", which is stage M−1).

In accordance with the exemplary embodiment of FIG. 18, each of the stages STAGE #1, STAGE #2, STAGE #3, STAGE #4, . . . , STAGE #N includes one input terminal (STVP or a terminal into which an output of the previous stage is inputted) and one clock input terminal (one terminal into which one of CKV1, CKVB1, CKV2, and CKVB2 is inputted). Each of the stages STAGE #1, STAGE #2, STAGE #3, STAGE #4, . . . , STAGE #N may further include a terminal (not shown) into which the low voltage Vss1 corresponding to the gate-off voltage is inputted. Further, each stage STAGE #1, STAGE #2, STAGE #3, STAGE #4, . . . , STAGE #N includes a gate voltage output terminal for outputting a gate voltage. In accordance with another exemplary embodiment of the present invention, each stage STAGE #1, STAGE #2, STAGE #3, STAGE #4, . . . , STAGE #N may further include an output terminal for outputting a transfer signal corresponding to the gate voltage or for outputting an output signal of an inverter included in a stage to the outside. Instead of the gate voltage, a transfer signal may be transferred to or fed into a previous stage, a subsequent stage, or a second previous stage.

The stages STAGE #1, STAGE #2, STAGE #3, STAGE #4, . . . , STAGE #N are connected to the gate lines one by one, and the output of each stage is applied as a gate voltage.

If the output is transferred from the subsequent stage to the present stage, the present stage may stop output of the gate-on signal or initialize a voltage charged in a node of the stage. Similarly, when the output is transferred from the second subsequent stage to the present stage, the present stage may initialize a voltage charged in a node of the stage.

The exemplary embodiments of FIG. 17 and FIG. 18 may be modified as in the additionally modified exemplary embodiments of FIG. 8 to FIG. 16.

Figure 19:
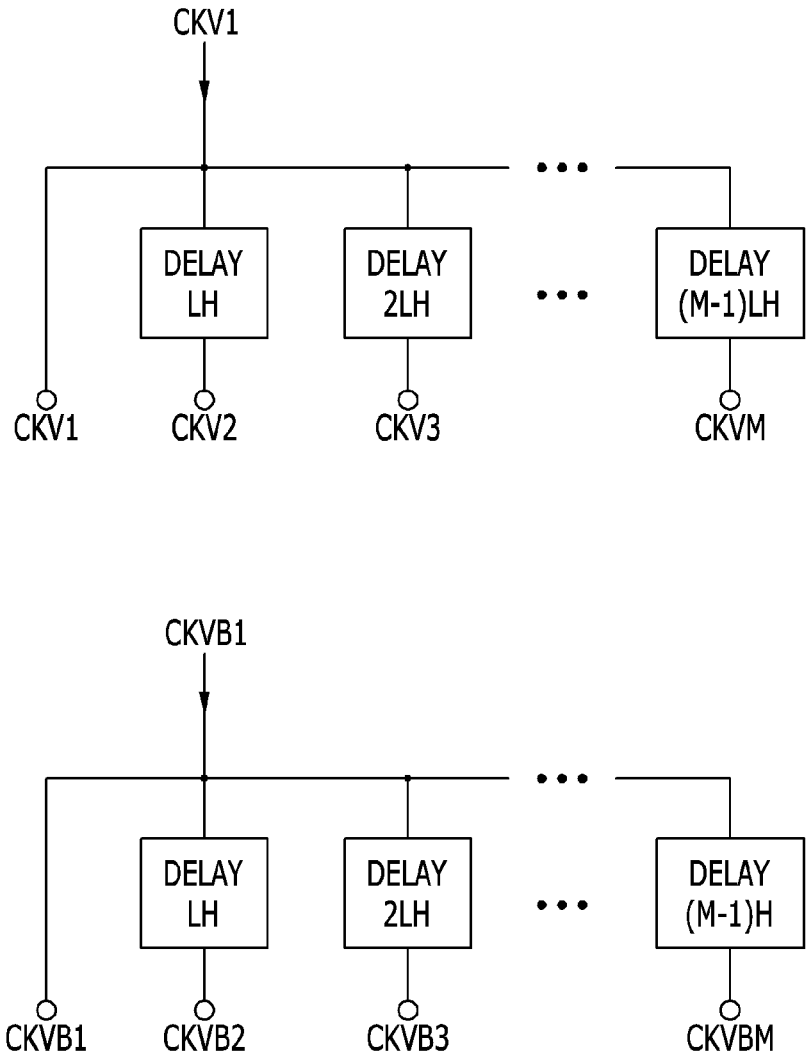
FIG. 19 is a diagram illustrating a clock signal generator to generate a clock signal and a clock-bar signal to be inputted in stages of a gate driver according to an exemplary embodiment of the present invention.

FIG. 19 is a diagram illustrating a clock signal generator to generate a clock signal and a clock-bar signal to be inputted in stages of a gate driver according to an exemplary embodiment of the present invention.

As shown in FIG. 19, a clock signal CKV1 may be used to generate a total of M clock signals CKV1, CKV2, . . . , and CKVM. A clock-bar signal CKVB1 may be used to generate a total of M clock-bar signals CKVB1, CKVB2, . . . , and CKVBM. Here, M is an integer. Delay elements may be used to divide the clock signal CKV1 or the clock-bar signal CKVB1. If the gate on time duration is 1H as shown in e.g., FIG. 15 and FIG. 16, the clock signal CKV1 may be delayed by L*H, 2L*H, . . . , (M−1)L*H to generate the clock signals CKV2, CKV3, . . . , CKVM, respectively. Further, the clock-bar signal CKVB1 may be delayed by L*H, 2L*H, . . . , (M−1)L*H to generate the clock-bar signals CKVB2, CKVB3, . . . , CKVBM, respectively. Referring to FIG. 16, CKV1 may be delayed by 4H to generate CKV2, and CKV1 may be delayed by 8H to generate CKV3. CKVB1 may be delayed by 4H to generate CKVB2, and CKVB1 may be delayed by 8H to generate CKVB3. Unlike FIG. 16, a portion of the delayed signals may have a constant voltage $V_{HIGH}$ rather than a constant voltage $V_{LOW}$, or may have a constant voltage $V_{LOW}$ rather than a constant voltage $V_{HIGH}$, both the constant voltage $V_{HIGH}$ and the constant voltage $V_{LOW}$ may be regarded as a non-wing voltage and the corresponding stage may output the same low gate voltage output in response to the constant voltage $V_{HIGH}$ or the constant voltage $V_{LOW}$.

Figure 20:
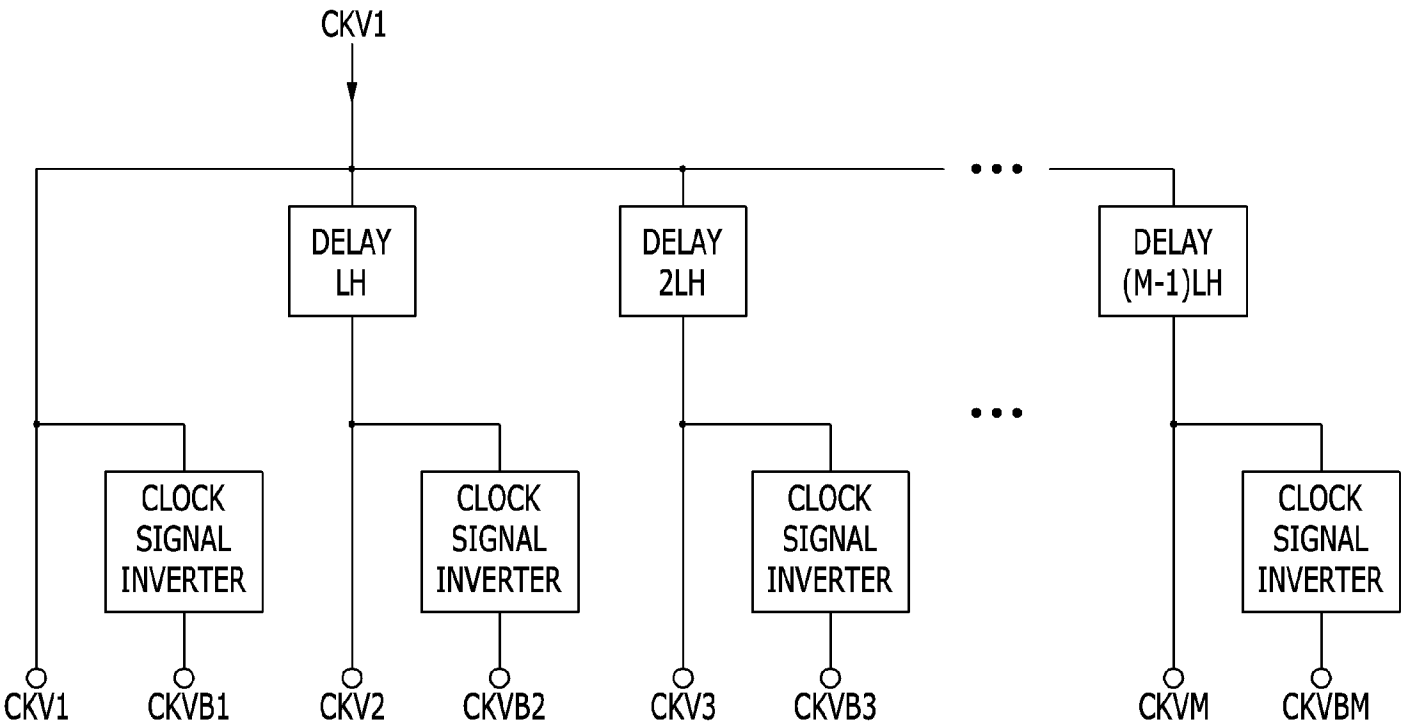
FIG. 20 is a diagram illustrating a clock signal generator to generate a clock signal and a clock-bar signal to be inputted in stages of a gate driver according to an exemplary embodiment of the present invention.

FIG. 20 is a diagram illustrating a clock signal generator to generate a clock signal and a clock-bar signal to be inputted in stages of a gate driver according to an exemplary embodiment of the present invention.

As shown in FIG. 20, a clock signal CKV1 may be used to generate a total of M clock signals CKV1, CKV2, . . . , and CKVM and to generate a total of M clock-bar signals CKVB1, CKVB2, . . . , and CKVBM. Here, M is an integer. Delay elements may be used to divide the clock signal CKV1. If the gate on time duration is 1H as shown in e.g., FIG. 15 and FIG. 16, the clock signal CKV1 may be delayed by L*H, 2L*H, . . . , (M−1)L*H to generate the clock signals CKV2, CKV3, . . . , CKVM, respectively. Further, the clock signals CKV1, CKV2, CKV3, . . . , CKVM may be inverted to generate the clock-bar signals CKVB1, CKVB2, CKVB3, . . . , CKVBM, respectively.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display panel comprising:

a display area configured to comprise a gate line and a data line; and a gate driver connected to one terminal of the gate line, the gate driver comprising a plurality of stages and being integrated on a substrate to output a gate voltage, wherein the stages are divided into at least two stage groups, a first pair of clock signals comprising a first clock signal and a first clock-bar signal is applied to a first stage group of the at least two stage groups, a second pair of clock signals comprising a second clock signal and a second clock-bar signal is applied to a second stage group of the at least two stage groups, the first pair of clock signals is not swung for a time period in one frame, and stages of the first stage group and stages of the second stage group are alternately arranged, such that the stages of the second stage group are disposed between stages of adjacent first stage groups.

2. The display panel of claim 1, wherein the first pair of clock signals and the second pair of clock signals have the same cycle.

3. The display panel of claim 1, wherein the first pair of clock signals is alternately applied to the first stage group, and a second pair of clock signals is alternately applied to the second stage group.

4. The display panel of claim 3, wherein the number of stages belonging to the first stage group is the same as the number of stages belonging to the second stage group.

5. The display panel of claim 4, wherein each of a first section in which the first pair of clock signals swings and a second section in which no swing is performed occupies about a half frame, and each of a first section in which the second pair of clock signals swings and a second section in which no swing is performed occupies about a half frame.

6. The display panel of claim 5, wherein the first section in which the first pair of clock signals swings is not overlapped with the first section in which the second pair of clock signals swings.

7. The display panel of claim 6, wherein a cycle of the clock signals in the first section in which the first pair of clock signals swings is the same as a cycle of the clock signals in the first section in which the second pair of clock signals swings.

8. The display panel of claim 4, wherein a line for feeding the first pair of clock signals to the first stage group is shorter than a line for feeding the second pair of clock signals to the second stage group.

9. The display panel of claim 3, wherein the number of stages belonging to the first stage group is different from the number of stages belonging to the second stage group.

10. The display panel of claim 9, wherein the first pair of clock signals has a first section in which the first pair of clock signals swings and a second section in which no swing is performed, and the second pair of clock signals has a first section in which the second pair of clock signals swings and a second section in which no swing is performed, and a size of the first section in which a pair of clock signals swings is proportional to the number of stages belonging to the corresponding stage group.

11. The display panel of claim 10, wherein the first section in which the first pair of clock signals swings and the first section in which the second pair of clock signals swings are not overlapped with each other in a time axis.

12. The display panel of claim 11, wherein a cycle of the clock signals in the first section in which the first pair of clock signals swings is the same as a cycle of the clock signals in the first section in which the second pair of clock signals swings.

13. The display panel of claim 3, wherein the first pair of clock signals has a first section in which the first pair of clock signals swings and a second section in which no swing is performed, and the second pair of clock signals has a first section in which the second pair of clock signals swings and a second section in which no swing is performed, and for the first pair of clock signals or the second pair of clock signals, the second section in which no swing is performed is located between first and second parts of the first section in one frame.

14. The display panel of claim 1, wherein the at least two stage groups further comprise a third stage group, and the first pair of clock signals is alternately applied to the first stage group, a second pair of clock signals is alternately applied to the second stage group, and a third pair of clock signals is alternately applied to the third stage group.

15. The display panel of claim 14, wherein the number of stages belonging to the first stage group, the number of stages belonging to the second stage group, and the number of stages belonging to the third stage group are the same.

16. The display panel of claim 15, wherein the first pair of clock signals has a first section in which the first pair of clock signals swings and a second section in which no swing is performed, the second pair of clock signals has a first section in which the second pair of clock signals swings and a second section in which no swing is performed, and the third pair of clock signals has a first section in which the third pair of clock signals swings and a second section in which no swing is performed, and the first section in which the first pair of clock signals swings, the first section in which the second pair of clock signals swings, and the first section in which the third pair of clock signals swings are not overlapped with each other in a time axis.

17. The display panel of claim 1, wherein an output of an Mth stage of the stages is applied to an (M+1)th stage, where M is a positive integer.

18. The display panel of claim 17, wherein the output of an (M+1)th stage of the stages is applied to an Mth stage, where M is a positive integer.

19. The display panel of claim 18, wherein the output of an Mth stage of the stages is applied to an (M+2)th stage, where M is a positive integer.

* * * * *